US011840835B2

(12) United States Patent
Sobel

(10) Patent No.: US 11,840,835 B2
(45) Date of Patent: Dec. 12, 2023

(54) WALL STUD ACOUSTIC PERFORMANCE

(71) Applicant: Hyperframe, Inc., Richmond, CA (US)

(72) Inventor: Kenneth Sobel, San Francisco, CA (US)

(73) Assignee: Hyperframe, Inc., Richmond, CA (US)

( * ) Notice: Subject to any disclaimer, the term of this patent is extended or adjusted under 35 U.S.C. 154(b) by 206 days.

(21) Appl. No.: 17/335,406

(22) Filed: Jun. 1, 2021

(65) Prior Publication Data

US 2021/0372121 A1 Dec. 2, 2021

Related U.S. Application Data

(60) Provisional application No. 63/033,062, filed on Jun. 1, 2020.

(51) Int. Cl.

| | |
|---|---|
| ***E04B 2/60*** | (2006.01) |
| ***E04B 1/82*** | (2006.01) |
| ***E04B 1/38*** | (2006.01) |
| *E04B 2/74* | (2006.01) |

(52) U.S. Cl.

CPC ..... *E04B 2/60* (2013.01); *E04B 1/388* (2023.08); *E04B 1/82* (2013.01); *E04B 2/7412* (2013.01)

(58) Field of Classification Search

CPC ..... E04B 2/60; E04B 1/40; E04B 1/82; E04B 2/7409; E04B 2/7414; E04B 2/7412

See application file for complete search history.

(56) References Cited

U.S. PATENT DOCUMENTS 2,058,386 A * 10/1936 Parsons ..... E04B 2/76 52/241
2,316,668 A * 4/1943 Bronner ..... E04B 2/58 52/424
3,270,472 A * 9/1966 Gilbert ..... E04B 2/7457 52/364
3,370,472 A * 2/1968 Cunningham ..... G01P 15/18 310/90
3,611,653 A * 10/1971 Zinn ..... E04B 2/7412 52/407.3

(Continued)

FOREIGN PATENT DOCUMENTS

AT 14226 U1 6/2015
JP 2010101052 A 5/2010

(Continued)

OTHER PUBLICATIONS

International Searching Authority, International Application No. PCT/US2021/035134, Written Opinion and International Search Report dated Sep. 6, 2021, 10 pages.

*Primary Examiner* — Phi D A
(74) *Attorney, Agent, or Firm* — POLSINELLI

(57) ABSTRACT

A framing assembly is disclosed including an acoustic framing arrangement and a plurality of tracks. The acoustic framing arrangement interconnects a top track with a bottom track. The acoustic framing arrangement includes a pair of studs positioned in back-to-back configuration and mechanically joined using a connector. The connector includes a vertical portion that extends between the pair of studs and a base portion that connects to the tracks. When assembled, the acoustic framing arrangement creates space between the pair of studs and positions the studs in an offset configuration to improve wall stud acoustic performance.

18 Claims, 27 Drawing Sheets

(56) References Cited

U.S. PATENT DOCUMENTS 4,018,020 A * 4/1977 Sauer ..... E04B 2/763 52/489.1
RE29,412 E * 9/1977 Zinn ..... E04B 2/7457 52/846
4,112,647 A * 9/1978 Scheid ..... E04B 2/7411 52/586.1
4,285,184 A * 8/1981 Turner, Jr. ..... E06B 5/205 52/404.3
4,397,127 A * 8/1983 Mieyal ..... E04B 2/789 52/745.12
5,297,369 A * 3/1994 Dickinson ..... E04C 2/386 52/404.3
5,493,834 A * 2/1996 Nelson ..... E04B 1/0007 52/274
5,497,591 A * 3/1996 Nelson ..... E04B 2/60 52/289
5,685,121 A * 11/1997 DeFrancesco ..... E04C 3/07 52/241
5,787,651 A * 8/1998 Horn ..... E04B 2/7412 52/846
6,125,608 A * 10/2000 Charlson ..... F16B 33/02 52/847
6,266,936 B1 * 7/2001 Gelin ..... E04B 9/001 52/712
7,571,578 B2 * 8/2009 Moody ..... E04B 2/58 52/407.4
7,946,384 B2 * 5/2011 Foster ..... E04B 2/7411 181/290
11,066,826 B2 * 7/2021 Wright ..... E04B 1/78
11,499,306 B2 * 11/2022 Schwab ..... F16B 5/0216
2012/0066993 A1 * 3/2012 Mommer ..... E04B 2/7854 52/309.4
2013/0025966 A1 * 1/2013 Nam ..... E04B 2/7457 181/290
2013/0078422 A1 * 3/2013 Tinianov ..... B32B 5/26 442/381
2015/0361659 A1 * 12/2015 Sessler ..... E04B 2/16 52/483.1
2017/0037619 A1 * 2/2017 Dietzen ..... E04C 3/11

FOREIGN PATENT DOCUMENTS

JP 5284754 B2 * 9/2013
KR 20100076393 A * 10/2010
WO 2019197052 A1 10/2019

* cited by examiner

WALL STUD ACOUSTIC PERFORMANCE

CROSS-REFERENCE TO RELATED APPLICATIONS

This non-provisional utility application claims the benefit of provisional patent application No. 63/033,062 filed on Jun. 1, 2020, which is hereby incorporated by reference to its entirety.

TECHNICAL FIELD

The present disclosure relates generally to construction and associated components; and more particularly to various construction components for improved wall stud acoustic performance.

BACKGROUND

Traditional methods for constructing residential and commercial buildings remain, for the most part, unchanged. During construction of a building, it is common to frame walls using light gauge steel framing components. Most metal frame walls are built on-site by skilled carpenters and installation involves a labor-intensive process. For rough framing projects in the United States, it is common for labor costs to exceed three times the material cost. In addition, labor costs may increase with a reduction in workforce availability.

In a standard configuration, frame assemblies such as metal frame walls include "tracks" and "studs" (or "joists") which may be fastened together to form a wall frame. In general, a pair of tracks may be horizontally aligned in parallel along opposite ends of the wall, and studs may be positioned vertically between the tracks, typically at regular intervals (e.g., 16-inches on center). Each of the studs may then be manually secured to the tracks by engaging fasteners through the flanges of the tracks and the stud. Other joining methods may be used, such as welding and riveting. This process generally forms the supporting structure of the wall frame.

In the design of a building, architects frequently specify interior partition walls that require high acoustic performance. The acoustic performance of a wall is typically represented by its Sound Transmission Class (STC) rating. Walls with high STC ratings have strong sound attenuation properties, such that airborne pressure waves generated on one side of the wall are highly attenuated as they travel through the thickness of the wall.

Mechanical vibration of the wall structure is a large contributor to sound transmission. When airborne pressure waves from a first room meet a wall structure, they cause it to vibrate. As the wall structure vibrates against the volume of air in the next room, it creates a new airborne pressure wave within that room. The new airborne pressure wave is the transmitted sound.

It is with these observations in mind, among others, that various aspects of the present disclosure were conceived and developed.

SUMMARY

The present disclosure provides a number of examples that describe construction framing assemblies and in particular acoustic framing arrangements that can be implemented for such framing assemblies in the course of constructing a wall or barrier. The acoustic framing arrangements reduce and/or minimize sound transmission for improved acoustic performance.

In one set of illustrative examples, the present disclosure takes the form of a framing assembly comprising an acoustic framing arrangement that may be used to interconnect tracks and form a portion of a wall or other barrier. The acoustic framing arrangement includes a first stud including a first stud web, a pair of first stud flanges in parallel arrangement and extending orthogonally from longitudinal edges of the first stud web, and a first embossment defined along a rear surface of the first stud web, the first stud defining a first stud end oriented towards the first track. The acoustic framing arrangement further includes a second stud including a second stud web, a pair of second stud flanges in parallel arrangement and extending orthogonally from longitudinal edges of the second stud web, and a second embossment defined along a rear surface of the second stud web, the second stud defining a second stud end oriented towards the first track. The acoustic framing arrangement further includes a first connector including a vertical portion and a base portion configured for engagement to the first track, the vertical portion disposed between the first stud and the second stud that connects with the first embossment and the second embossment. In this example, the acoustic framing arrangement defines a channel between the first stud and the second stud to mechanically isolate the first stud from the second stud, and the first connector is engaged to the first stud and the second stud such that the first stud end is offset relative to the second stud end. The acoustic framing arrangement may include a slot defined along the vertical portion of the first connector such that the vertical portion of the first connector is slidable a predetermined distance along the first embossment and the second embossment by nature of the slot to accommodate head-of-wall deflection with respect to the first track. The channel extends from the first embossment and the second embossment to a predetermined position along the first stud and the second stud, the channel creating separation and reducing sound transmission through the first stud and the second stud. The first track includes a first track web, a first flange extending along a first side of the first track web, and a second flange extending along a second side of the first track web opposite the first side, the first track defining a first track channel between the first flange and the second flange of the first track. The acoustic framing arrangement is configured to engage with the first track such that the second stud abuts the second flange of the first track and a gap is defined between the first stud and the second flange of the first track. The framing assembly may include a first wall covering disposed over the first flange of the first track; and a second wall covering disposed over the second flange of the first track, wherein a gap is defined between a first flange of the pair of first stud flanges of the first stud and the second wall covering. By assumption of the acoustic framing arrangement the rear surface of the first stud is separated from the rear surface of the second stud, and the first stud end and the second stud end are offset from one another relative to the first flange and the first track channel of the first track. The framing assembly may include a second track vertically aligned over the first track, the second track including a second track web, and a pair of second track flanges in parallel arrangement and extending orthogonally from longitudinal edges of the second track web, the second track defining a second track channel between the pair of second track flanges, the acoustic framing arrangement interconnecting the first track with the second track and disposed between the first track and the second track. The framing assembly may include a third embossment defined along the rear surface of the first stud a predetermined distance from the first embossment, a fourth embossment defined along the rear surface of the second stud and positioned the predetermined distance from the second embossment, the fourth embossment oriented towards the third embossment, and a second connector including a vertical portion and a base portion in communication with the vertical portion, the vertical portion of the second connector disposed between and engaged to the third embossment and the fourth embossment. The framing assembly may include a snap-fit mechanism that mechanically engages the first connector of the acoustic framing arrangement to the first track, including: an opening and a tab formed adjacent the opening along the base portion of the first connector, and a track clamp defined along a web of the first track that passes through the opening and locks about the base portion of the first connector such that an end of the track clamp rests against a bottom surface of the base portion restricting movement of the first connector away from the first track. The channel may be air-filled or include an acoustic insulation layer disposed within the channel.

In another set of illustrative examples, the present disclosure takes the form of a framing assembly comprising an acoustic framing arrangement that may be used to interconnect tracks and form a portion of a wall or other barrier. The acoustic framing arrangement includes a first stud including a first stud web, a pair of first stud flanges in parallel arrangement and extending orthogonally from longitudinal edges of the first stud web, and a first embossment defined along a rear surface of the first stud web, a second stud including a second stud web, a pair of second stud flanges in parallel arrangement and extending orthogonally from longitudinal edges of the second stud web, and a second embossment defined along a rear surface of the second stud web, the rear surface of the second stud oriented towards the rear surface of the first stud, wherein the first stud is interconnected with the second stud such that that first embossment is mechanically couples to the second embossment, the first embossment and the second embossment separating the rear surfaces of the first and second stud respectively.

In another set of illustrative examples, the present disclosure takes the form of a framing assembly comprising an acoustic framing arrangement that may be used to interconnect tracks and form a portion of a wall or other barrier. The acoustic framing arrangement includes an acoustic framing arrangement configured for connection to a track, including: a first stud including a first stud web and a pair of first stud flanges in parallel arrangement and extending orthogonally from longitudinal edges of the first stud web, a second stud including a second stud web and a pair of second stud flanges in parallel arrangement and extending orthogonally from longitudinal edges of the second stud web, the first stud and the second stud aligned in a parallel configuration, a first connector including a vertical portion and a base portion, the vertical portion disposed between and interconnecting the first stud with the second stud, the first connector separating the first stud from the second stud and interconnecting the first stud in an offset position relative to the second stud.

In another set of illustrative examples, the present disclosure takes the form of a method of making a framing assembly comprising an acoustic framing arrangement that may be used to interconnect tracks and form a portion of a wall or other barrier. The method includes the steps of forming an acoustic framing arrangement configured for connection to a track, including: providing a first stud including a first stud web, a pair of first stud flanges in parallel arrangement and extending orthogonally from longitudinal edges of the first stud web; providing a second stud including a second stud web, a pair of second stud flanges in parallel arrangement and extending orthogonally from longitudinal edges of the second stud web, the first stud and the second stud aligned in a parallel configuration such that a rear surface of the first stud is oriented towards a rear surface of the second stud; and interconnecting the first stud with the second stud using a first connector defining a base portion and a vertical portion, the first connector separating the rear surface of the first stud from the rear surface of the second stud and interconnecting the first stud in an offset position relative to the second stud.

In another set of illustrative examples, the present disclosure takes the form of a method of making a framing assembly comprising an acoustic framing arrangement that may be used to interconnect tracks and form a portion of a wall or other barrier. The method includes the steps of forming an acoustic framing arrangement configured for connection to a track, including: providing a first stud including a first stud web, a pair of first stud flanges in parallel arrangement and extending orthogonally from longitudinal edges of the first stud web; providing a second stud including a second stud web, a pair of second stud flanges in parallel arrangement and extending orthogonally from longitudinal edges of the second stud web, the first stud and the second stud aligned in a parallel configuration such that a rear surface of the first stud is oriented towards a rear surface of the second stud; and interconnecting the first stud with the second stud using a connector such that the first stud and the second stud are in back-to-back alignment with a gap defined in between the rear surfaces of the first stud and the second stud, the first stud in offset configuration relative to the second stud.

The foregoing examples broadly outline various aspects, features, and technical advantages of examples according to the disclosure in order that the detailed description that follows may be better understood. It is further appreciated that the above operations described in the context of the illustrative example method, device, and computer-readable medium are not required and that one or more operations may be excluded and/or other additional operations discussed herein may be included. Additional features and advantages will be described hereinafter. The conception and specific examples illustrated and described herein may be readily utilized as a basis for modifying or designing other structures for carrying out the same purposes of the present disclosure. Such equivalent constructions do not depart from the spirit and scope of the appended claims.

BRIEF DESCRIPTION OF THE DRAWINGS

The examples herein may be better understood by referring to the following description in conjunction with the accompanying drawings in which like reference numbers indicate the same or functionally similar elements. Understanding that these drawings depict only exemplary examples of the disclosure and are not therefore to be considered to be limiting of its scope, the principles herein are described and explained with additional specificity and detail through the use of the accompanying drawings in which.

Corresponding reference characters indicate corresponding elements among the view of the drawings. The headings used in the figures do not limit the scope of the claims.

DESCRIPTION

Overview.

It is desirable to introduce a labor-efficient wall stud acoustic framing arrangement that can achieve the acoustic performance of a chase wall within a single thickness wall, without the need for a resilient channel. According to one or more examples or examples of the present disclosure, the acoustic framing arrangement described herein generally includes a pair of studs (first stud and second stud) aligned in back-to-back parallel alignment. The pair of studs may be interconnected via a connector. The connector and the studs are positioned and connected such that the studs and the connector form an acoustic framing arrangement such that one or more of a gap and/or channel is defined between the studs, and the studs are in an offset configuration, as further described herein.

Description.

Various examples of the disclosure are discussed in detail below. While specific implementations are discussed, it should be understood that this is done for illustration purposes only. A person skilled in the relevant art will recognize that other components and configurations may be used without parting from the spirit and scope of the disclosure.

As used herein, the terms "building," "structure," and/or "construction site" may be used interchangeably and generally refer to a physical structure on real property such as residential or commercial properties.

Figure 1:
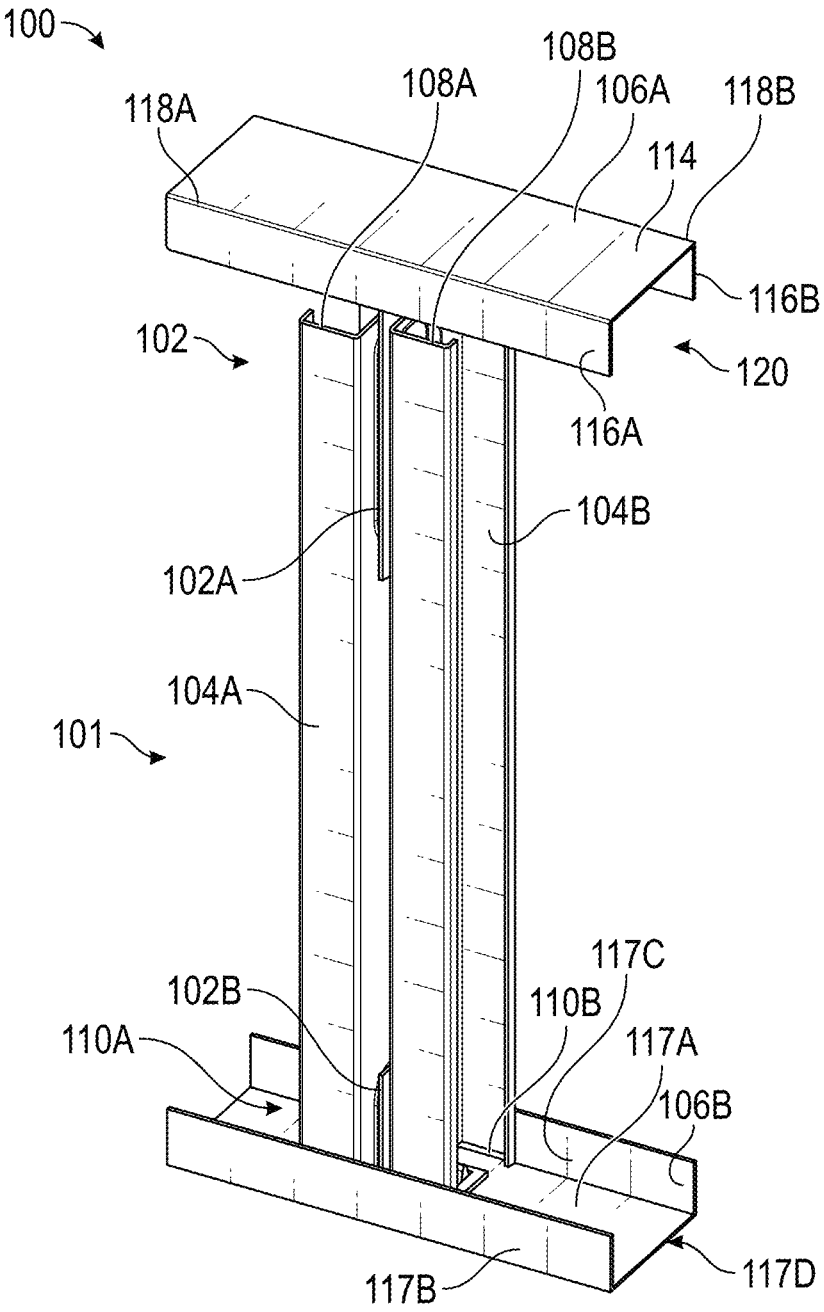
FIG. 1 is an isometric view of a framing assembly including an acoustic framing arrangement according to one example of the present novel disclosure.
Figure 2:
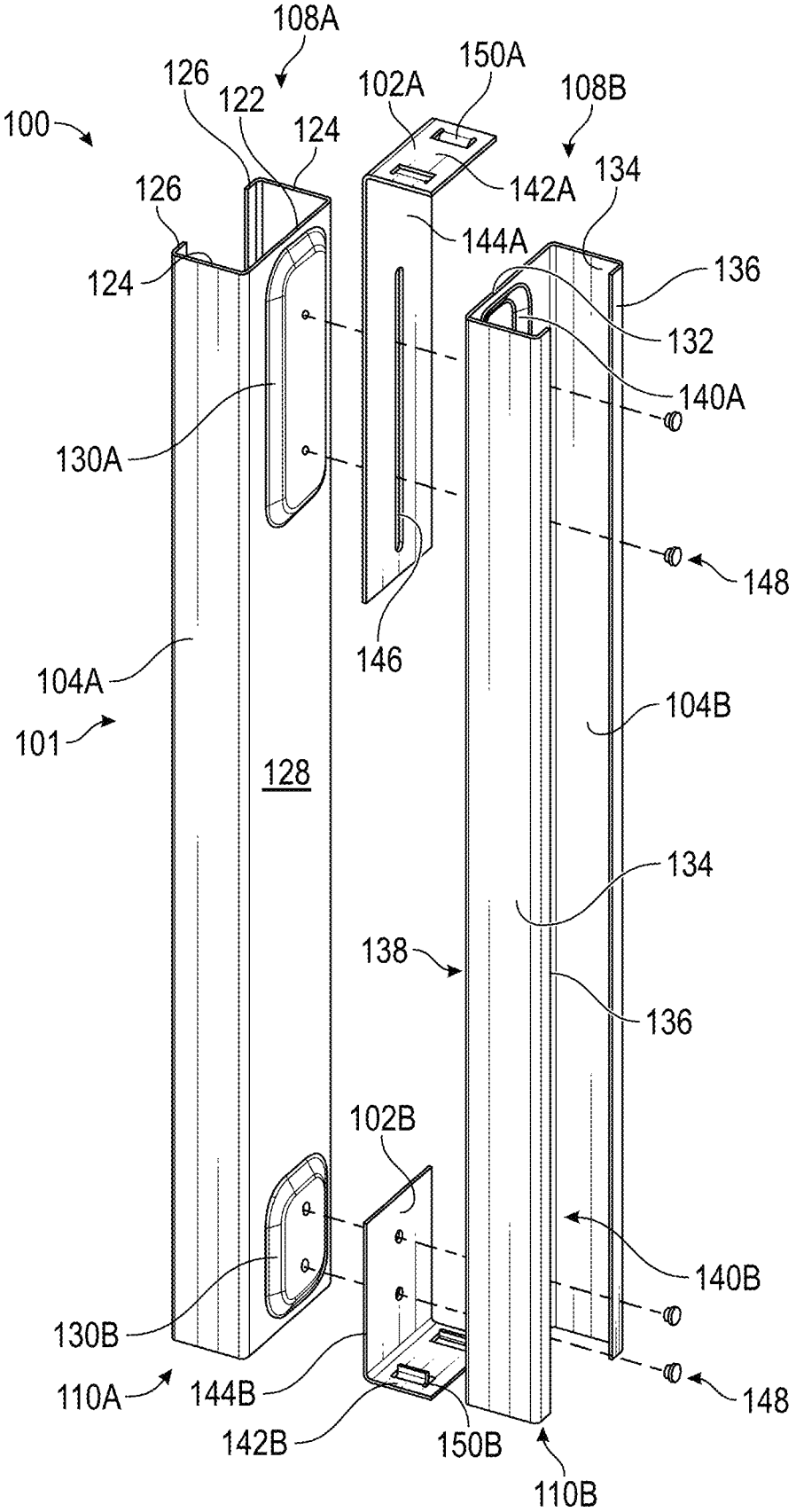
FIG. 2 is an isometric exploded view of the acoustic framing arrangement of FIG. 1.
Figure 3:
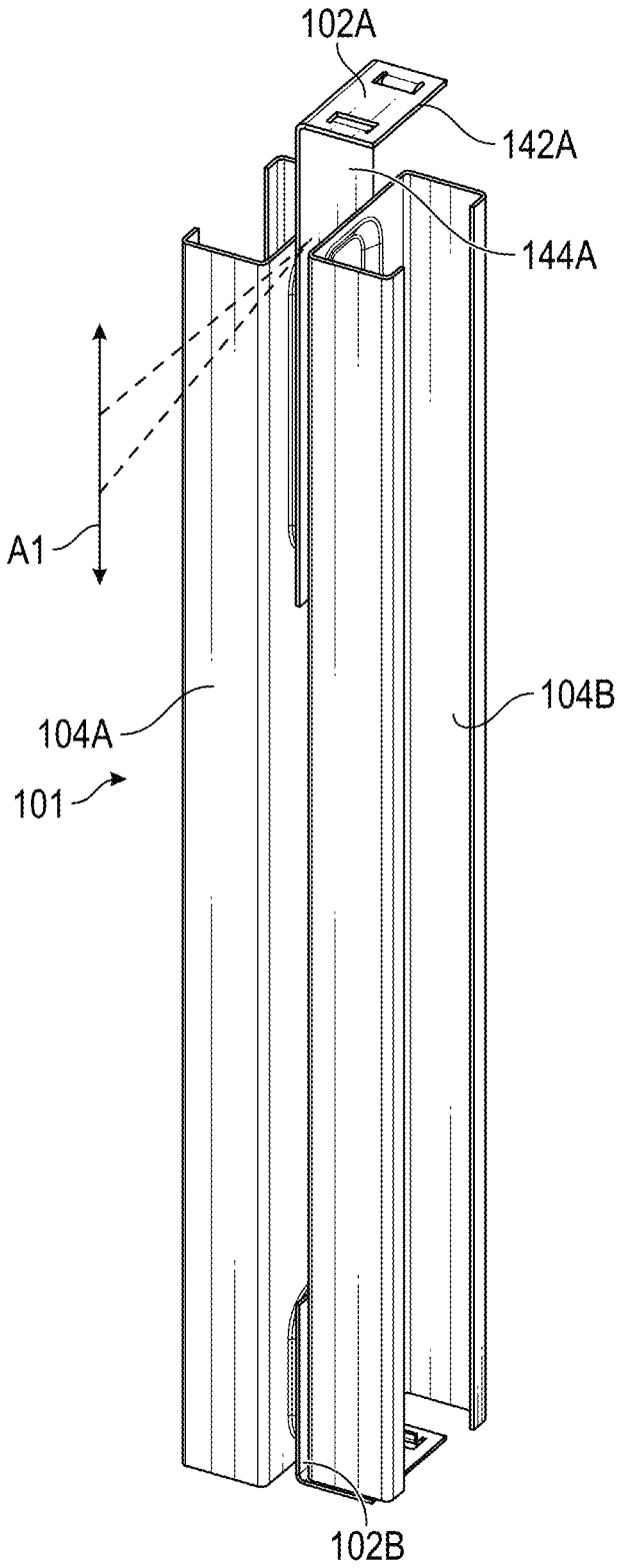
FIG. 3 is an isometric view of the acoustic framing arrangement of FIG. 2.

Referring to FIGS. 1-3, a framing assembly 100 is presented illustrating a first example of an acoustic framing arrangement 101 with various framing components interconnected using one or more of a connector 102. In the example shown, the acoustic framing arrangement 101 includes a pair of studs 104 positioned in a back-to-back configuration, with connectors 102 positioned between the studs 104. More specifically, the acoustic framing arrangement 101 includes a first connector 102A positioned between a first stud 104A and a second stud 104B. Optionally, a second connector 102B is also positioned between the first stud 104A and the second stud 104B a predetermined distance from the first connector 102A.

As shown, a top track 106A is positioned above the acoustic framing arrangement 101 and a bottom track 106B is positioned below the acoustic framing arrangement 101 opposite the top track 106A. In particular, the top track 106A is positioned over a first end 108A of the first stud 104A and a first end 108B of the second stud 104B. Similarly, the bottom track 106B is positioned over a second end 110A of the first stud 104A and a second end 110B of the second stud 104B. The top track 106A may be connected to the first end 108A of the first stud 104A and the first end 108B of the second stud 104B, and the bottom track may be connected to the second end 110A of the first stud 104A and the second end 110B of the second stud 104B using various examples of snap-fit connections or via simple mechanical connections, as further described herein.

As indicated, the first track 106A includes a track web 114, a first track flange 116A, and a second track flange 116B. The first track flange 116A is defined along a first lateral edge 118A of the track web 114, and the second track flange 116B is defined along a second lateral edge 118B of the track web 114 opposite the first lateral edge 118A. The first track 106A further defines a track channel 120 formed collectively by the track web 114, the first track flange 116A, and the second track flange 116B. In general, the first track 106A is identical in form and shape with respect to any one of the tracks 106 (e.g., track 106B includes identical structures including a web 117A, and a pair of flanges 117B-117C collectively defining a track channel 117D), such that each of the tracks 106 generally share a common or uniform profile configuration. In some cases, the track 106A may be referred to as a U-shaped track (or U-shaped joist) widely available and often deployed in framing applications.

As further indicated, the first stud 104A includes a first stud web 122, a pair of first stud flanges 124 in parallel arrangement and extending orthogonally from longitudinal edges of the first stud web 122, and a pair of returns 126 defined along the pair of first stud flanges 124. In addition, the first stud 104A defines a back surface 128 of the web 122, and at least one of an embossment 130 defined along the back surface 128 of the web 122 as shown. The embossment/s 130 (and the embossment/s 140) generally comprises a protrusion, or structure formed along and/or extending from the back surfaces of the studs 104 as shown. Optionally, the embossment 130 may include a first embossment 130A and a second embossment 130B defined a predetermined distance from one another along the back surface 128 of the first stud 104A. Similarly, the second stud 104B includes a second stud web 132, a pair of second stud flanges 134 in parallel arrangement and extending orthogonally from longitudinal edges of the second stud web 132, and a pair of returns 136 defined along the pair of second stud flanges 134. In addition, the second stud 104B defines a back surface 138 of the web 132 oriented towards the back surface 128 of the first stud 104A. The second stud 104B includes at least one of an embossment 140 defined along the back surface 138 of the web 132 as shown. Optionally, the embossment 140 also includes a first embossment 140A and a second embossment 140B defined a predetermined distance from one another along the back surface 138 of the second stud 104B. In general, the stud 104A is identical in form and shape with respect to any one of the studs 104 (e.g., stud 104B), such that each of the studs 104 generally shares a common or uniform profile configuration. In some examples, the studs 104 may be C-shaped by nature of the returns 126 and the returns 136. In other cases, any of the studs 104 may be a U-shaped stud (or U-shaped joist).

FIG. 2 illustrates that each of the connectors 102 includes a base portion 142 and a vertical portion 144. In the example shown, the first connector 102A includes a base portion 142A that abuts the top track 106A and a vertical portion 144A that extends between the back surface 128 of the first stud 104A and the back surface 138 of the second stud 104B. The second connector 102B includes a base portion 142B that engages the bottom track 106B and a vertical portion 144B that that extends between the back surface 128 of the first stud 104A and the back surface 138 of the second stud 104B towards the first connector 102A. In some examples, the connectors 102 may include various features that facilitate and/or optimize connection to adjacent components. As one particular example, the first connector 102A may include a slot 146 defined along the vertical portion 144A as shown. As indicated in FIG. 2, a plurality of securing members 148 (e.g., bolts, screws, and the like) pass through the slot 146 and connect to the first embossment 130A of the first stud 104A with the first embossment 140A of the second stud 104B. As illustrated in FIG. 3, with the slot 146, the first connector 102A is slidable a predetermined distance (A1) along the first embossment 130A and the first embossment 140A to, e.g., accommodate head-of-wall deflection with respect to the first track 106A. More specifically, where the base portion 142A of the first connector 102A is engaged to the first track 106A (FIG. 1), the first connector 102A is movable about a vertical axis (A1) to and/or away from the bottom track 106B and the second connector 102B (FIG. 3) relative to the first stud 104A and the second stud 104B as the securing member 148 navigates along the slot 146. Any forces imposed upon the top track 106A (connected to first connector 102A) may initiate such movement for head-of-wall deflection or other advantages. Conversely, in some examples as shown in FIG. 2, the second connector 102B is positioned between the first stud 104A and the second stud 104B and mounted to the second embossment 130B and the second embossment 140B in a fixed position. In addition, some examples of the connectors 102 include a connection mechanism 150 (FIGS. 5-7) that facilitates engagement between the connectors 102 and the tracks 106, denoted as connection mechanism 150A of the first connector 102A and connection mechanism 150B of the second connector 102B, and further described herein.

Figure 4A:
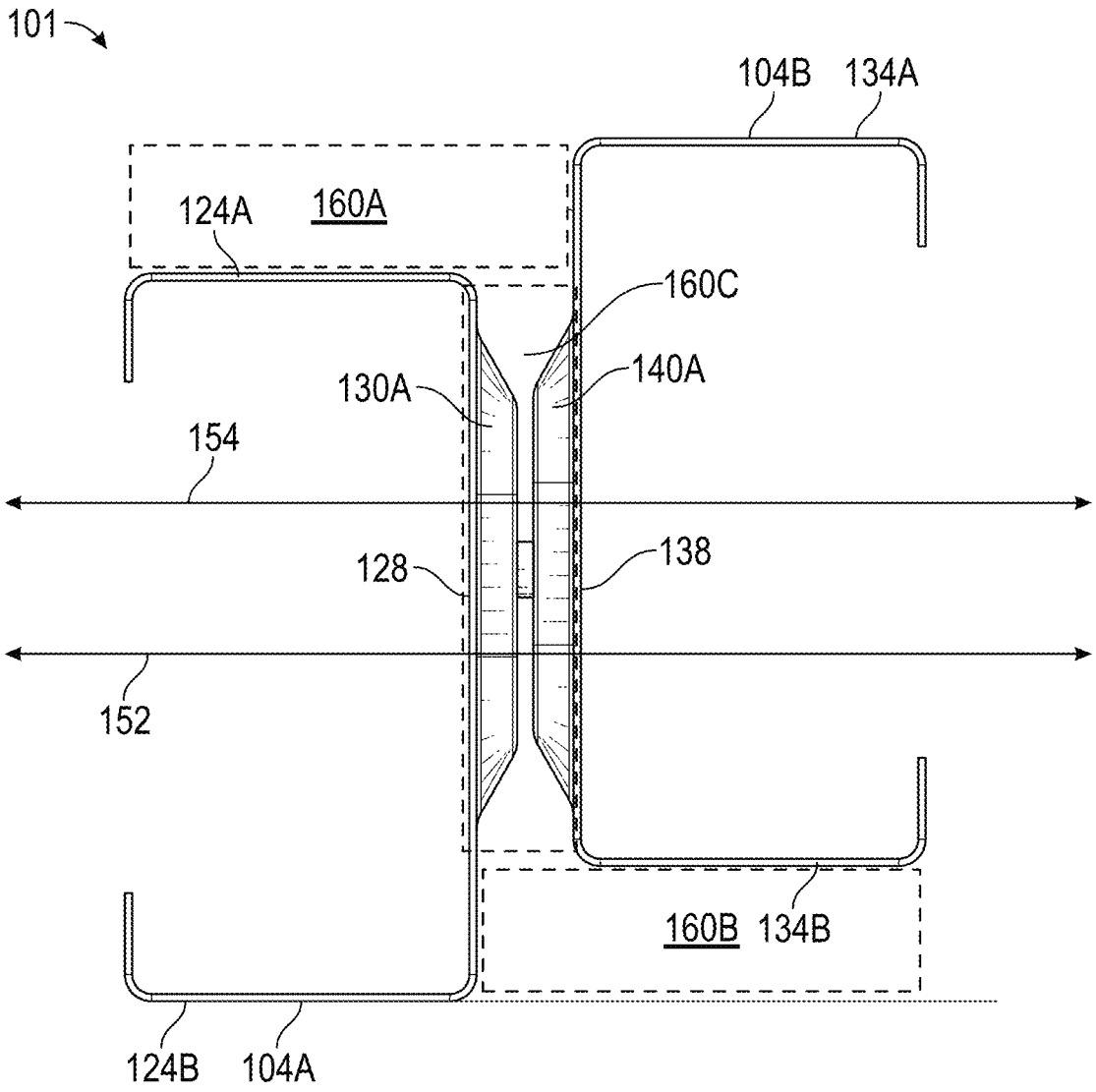
FIG. 4A is a top or plan view of the acoustic framing arrangement of FIG. 2 with the top track and connectors removed for illustration, and also the first and second (top and bottom) connectors removed.
Figure 4B:
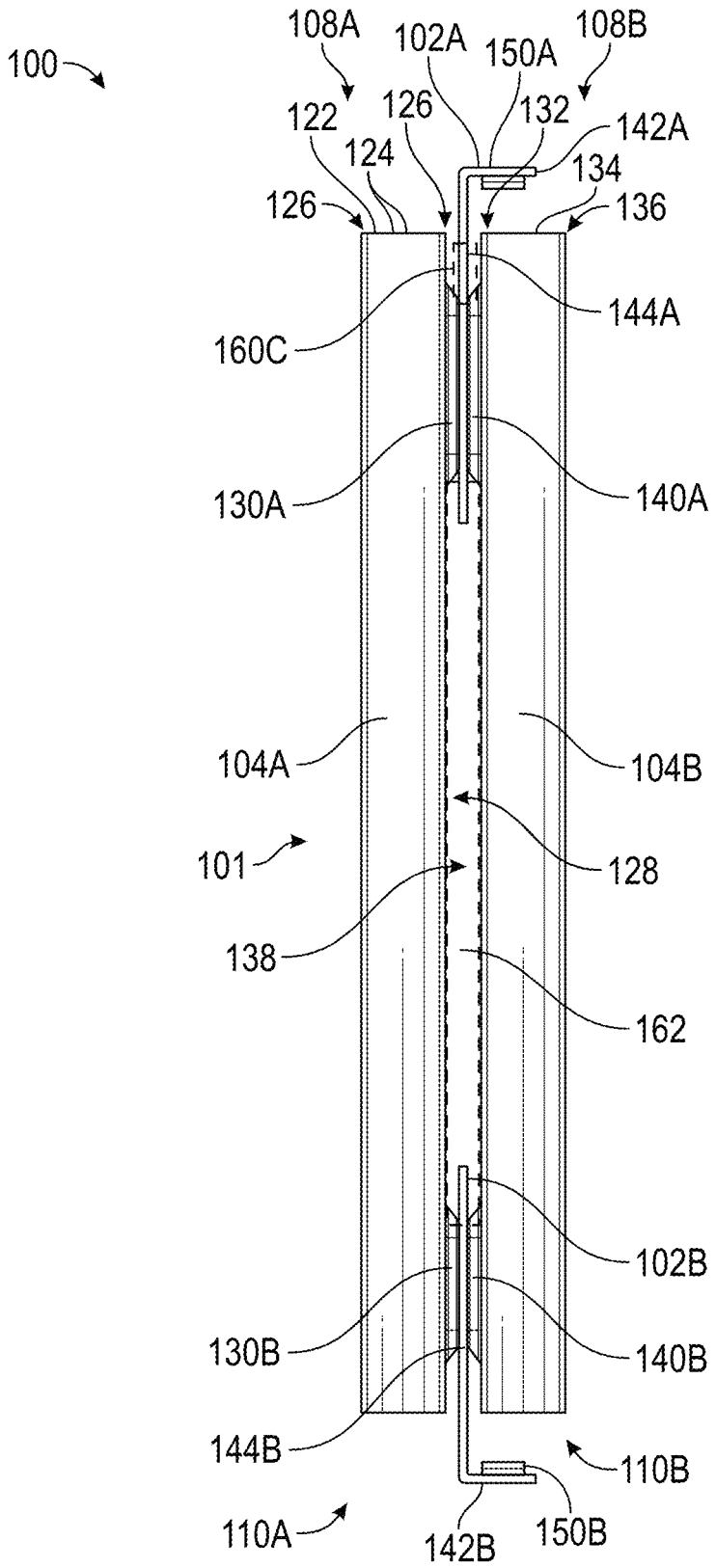
FIG. 4B is a side view of the acoustic framing arrangement of FIG. 2 illustrating the position of the embossments, the studs, and the first/top connector relative to other components.
Figure 4C:
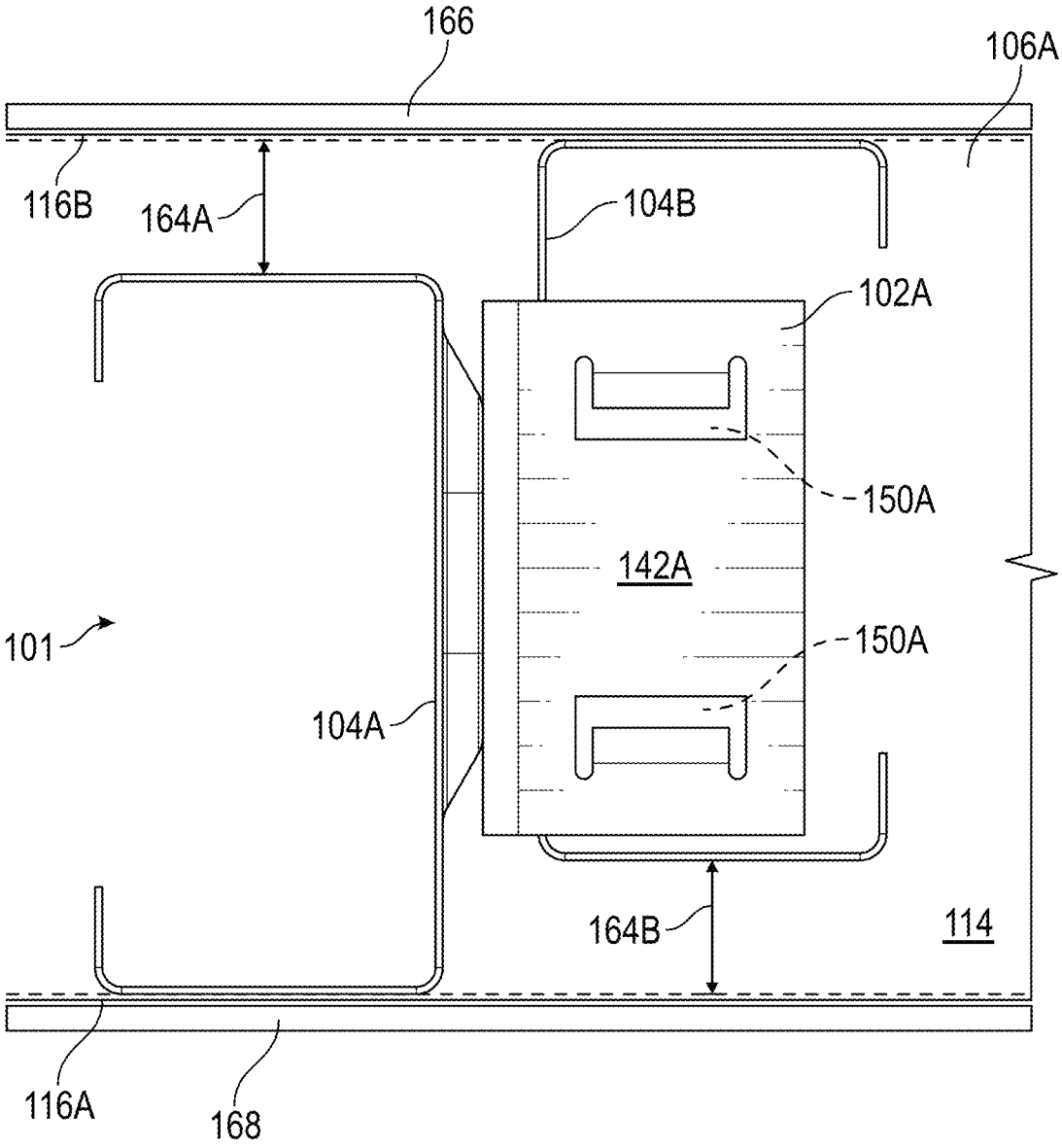
FIG. 4C is another top or plan view of the acoustic framing arrangement of FIG. 2 with the top track shown in phantom to illustrate its relationship and position relative to other components.

FIGS. 4A-4C illustrate further detail regarding the connections and orientation between the components of the acoustic framing arrangement 101 and efficacy thereof. FIG. 4A in particular shows a top view of the acoustic framing arrangement 101 with the connectors 102 removed to illustrate other features, and FIG. 4B illustrates the position of the base portion 142A relative to the studs 104. As indicated, when interconnected by the connectors 102, the studs 104 are in an offset configuration relative to one another. More specifically as indicated in FIG. 4A for example, a cross-sectional center axis 152 of the first stud 104A is spaced apart from a cross-sectional center axis 154 of the second stud 104B. In this manner, the first stud 104A and the second stud 104B are oriented back-to-back (rear surface 128 of the first stud 104A is oriented towards rear surface 138 of the second stud 104B) but the flanges 124 and the flanges 134 of the first stud 104A and the second stud respectively are not in alignment and instead extend along different respective planes. In other words, the first end 108A of the first stud 104A is offset relative to the first end 108B of the second stud 104B (FIG. 2), such that the first stud 104A and the second stud 104B are in the offset configuration shown in FIG. 4A and other figures.

To form the offset configuration of the first stud 104A relative to the second stud 104B, different variations are contemplated. For example, in some examples, the slot 146 is formed in an off-center position along the vertical portion 144A of the first connector 102A. In other examples, the securing members 148 may simply be connected to e.g., the second stud 104B, pass through the slot 146, and may be mounted to the first embossment 130A of the first stud 104A in a position of the embossment 130A that is off-center relative to a center longitudinal position of the stud. As another example, any of the embossments 130 or the embossments 140 may be formed off-center relative to the back surface 128 or the back surface 138. This example is shown in FIG. 2—the embossment 130A is formed off-center relative to the back surface 128 of the stud 104A, such that the engagement positions of the securing members 148 bring together the first stud 104A and the second stud 104B in the offset configuration shown in FIG. 4A. Numerous other variations are contemplated to bring together and connect the first stud 104A with the second stud 104B in the offset configuration shown in FIG. 4A. In some examples, each of the connectors 102 engage with the embossments 130 and the embossments 140 and maintain the studs 104 in the general off-set configuration as shown.

Various regions, channels, and gaps of space are defined along the acoustic framing arrangement 101 where portions of the acoustic framing arrangement are devoid of physical structure; enhancing the acoustic properties of the acoustic framing arrangement 101, as further described herein. As indicated for example, regions 160 define portions of the acoustic framing arrangement devoid of physical structure and defined proximate to the studs 104. Specifically, a region 160A is defined along the flange 124A of the first stud 104A and the back surface 138 of the second stud 104B, and a region 160B is defined along the flange 134B of the second stud 104B and the back surface 128 of the first stud 104A. Each of the regions 160A-160B extend longitudinally along a length of the studs 104 of the acoustic framing arrangement 101.

As further indicated in FIG. 4B, another region 160, denoted region 160C, is defined between the embossment 130A, the embossment 140A, the top end 108A of the first stud 104A and the top end 108B of the second stud 104B. As such, the region 160C (which is optional) provides further separation between the first stud 104A and the second stud 104B proximate to the top track 106A. In addition, a channel 162 is defined between the first stud 104A and the second stud 104B along a general center position of the acoustic framing arrangement 101. In general, the channel 162 extends from the first embossment 130A of the first stud 104A and the first embossment 140A of the second stud 104B to the second embossment 130B of the first stud 104A and the second embossment 140B of the second stud 104B. Like the regions 160, the channel 162 provides separation and physical space devoid of structure along the general center portion of the acoustic framing arrangement 101, contributing to minimization of sound transfer.

Referring to FIG. 4C, when the top track 106A is arranged about the acoustic framing arrangement 101 and the base portion 142A of the first connector 102A is mounted to the top track 106A as described herein, the first stud 104A is positioned beneath and/or abuts the first flange 116A of the top track 106A; and similarly the second stud 104B is positioned beneath and/or abuts the second flange 116B of the top track 106A. However, the first stud 104A is separated or offset from the second flange 116B of the top track 106A by a gap 164A, and the second stud 104B is separated or offset from the first flange 116A of the top track 106A by a gap 164B. In addition, wall coverings may be positioned along the flanges 116 of the top track 106A. As shown, a wall covering 166 may be positioned along the flange 116B of the top track 106A, and a wall covering 168 may be positioned along the flange 116A of the top track 106A. The regions 160, channel 162, and gaps 164 all contribute to a reduction in (or otherwise minimize) sound transmission from the wall covering 166 to the wall covering 168.

Figure 5:
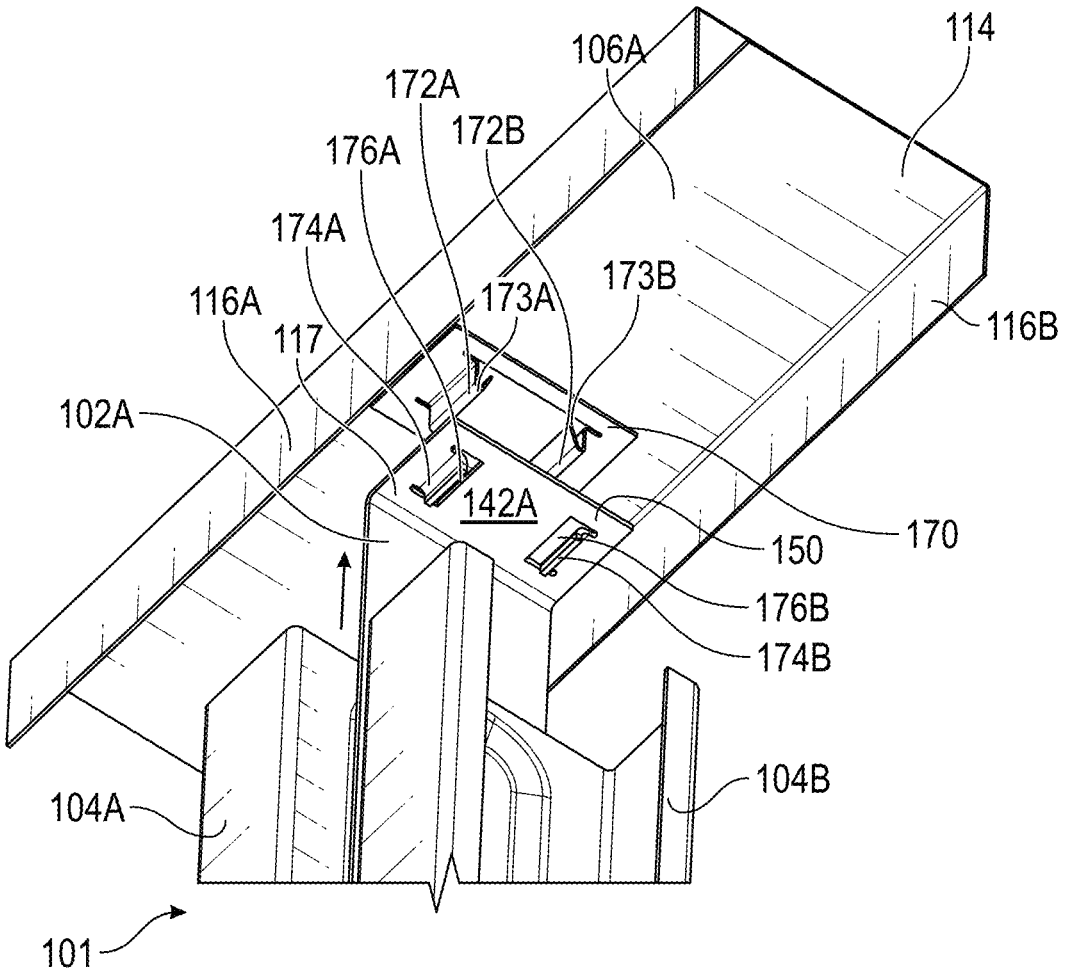
FIG. 5 is a perspective view of a first phase of a connection between the acoustic framing arrangement of FIG. 2 and a track.
Figure 6:
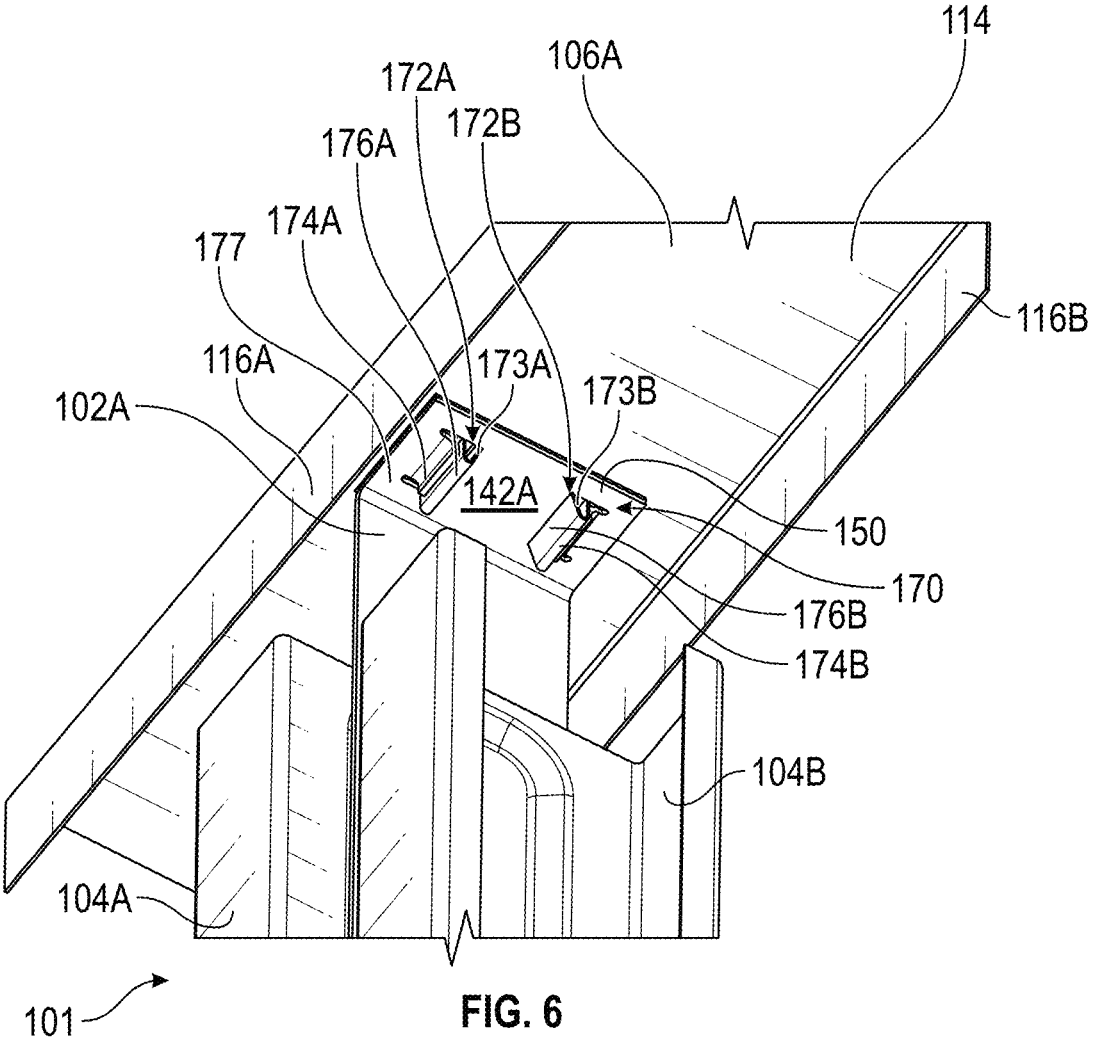
FIG. 6 is a perspective view of a second phase of a connection between the acoustic framing arrangement of FIG. 2 and the track.
Figure 7:
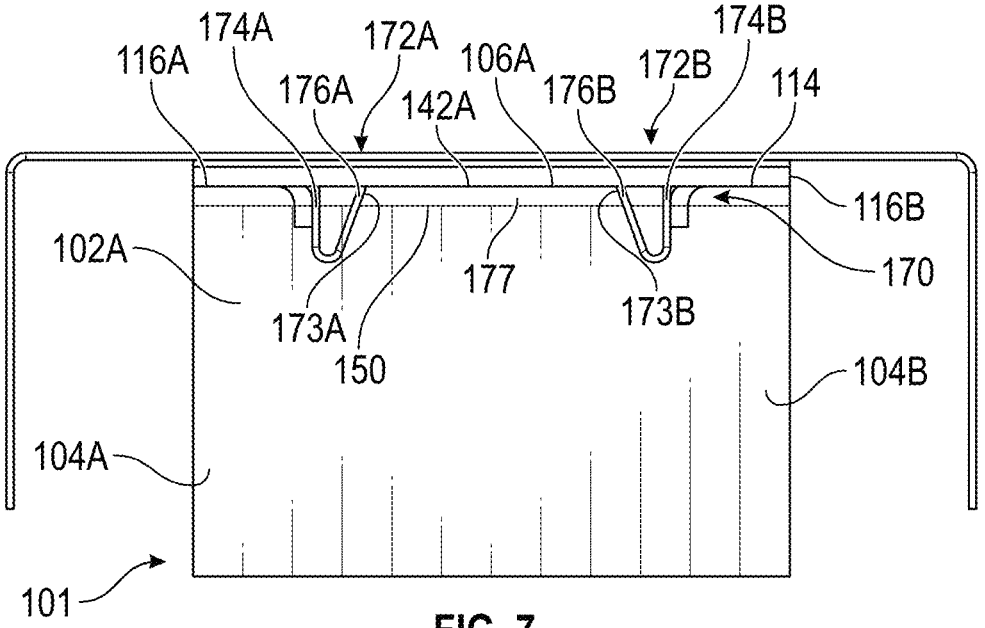
FIG. 7 is a side view of the second phase of a connection between the acoustic framing arrangement of FIG. 2 and the track.
Figure 8A:
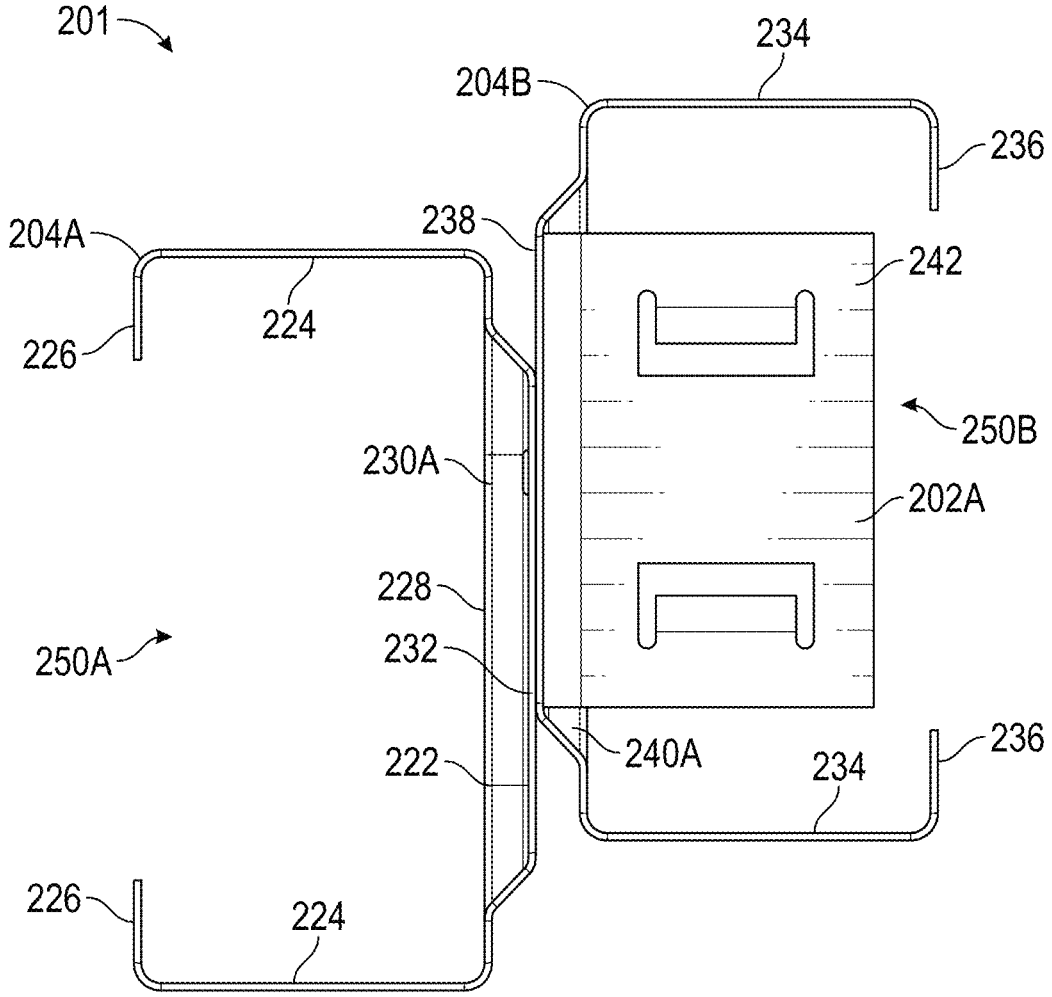
FIG. 8A is a top or plan view of another example of an acoustic framing arrangement with an offset stud configuration and a connector interconnecting the studs disposed within a stud channel.
Figure 8B:
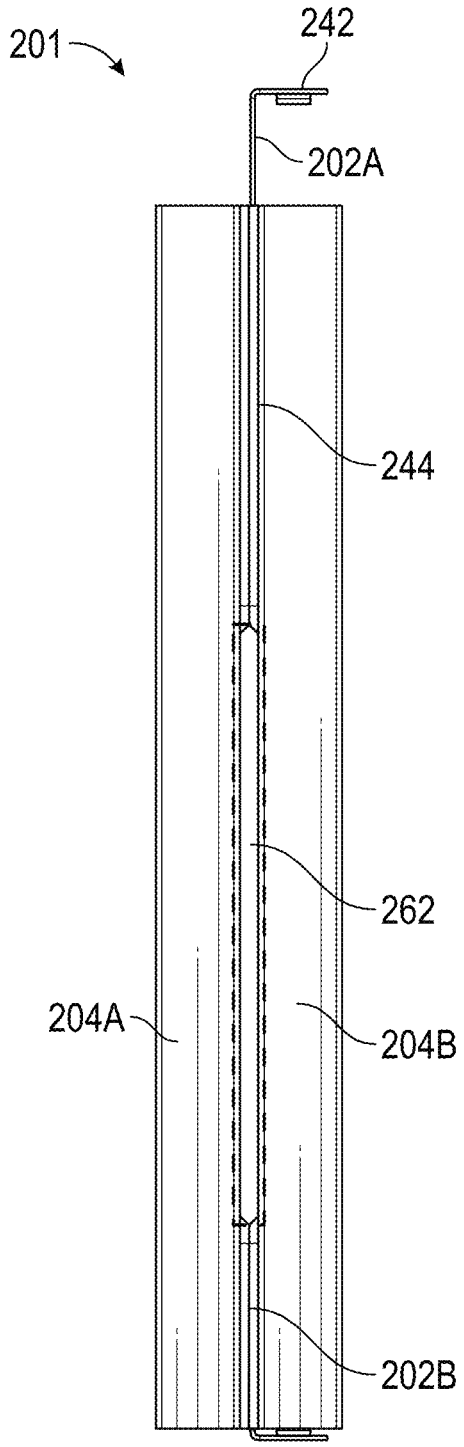
FIG. 8B is a side view of the acoustic framing arrangement of FIG. 8A.
Figure 8C:
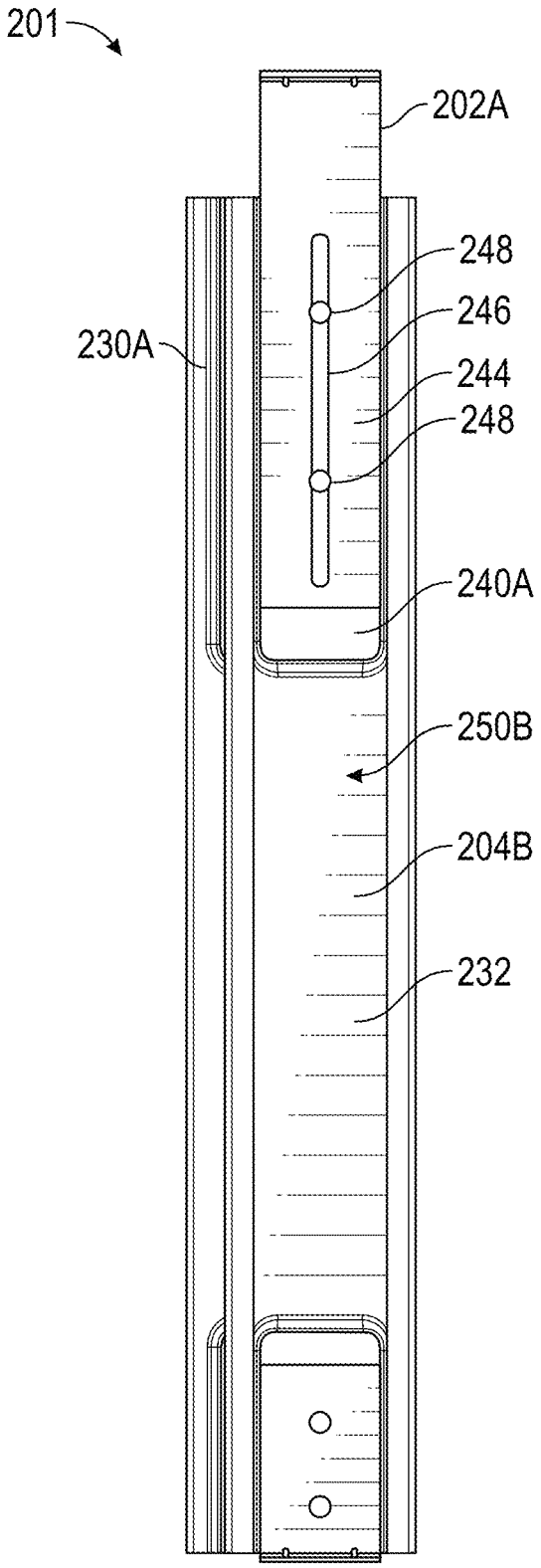
FIG. 8C is another side view of the acoustic framing arrangement of FIG. 8A illustrating the positioning of a portion of a connector within a stud channel.
Figure 8D:
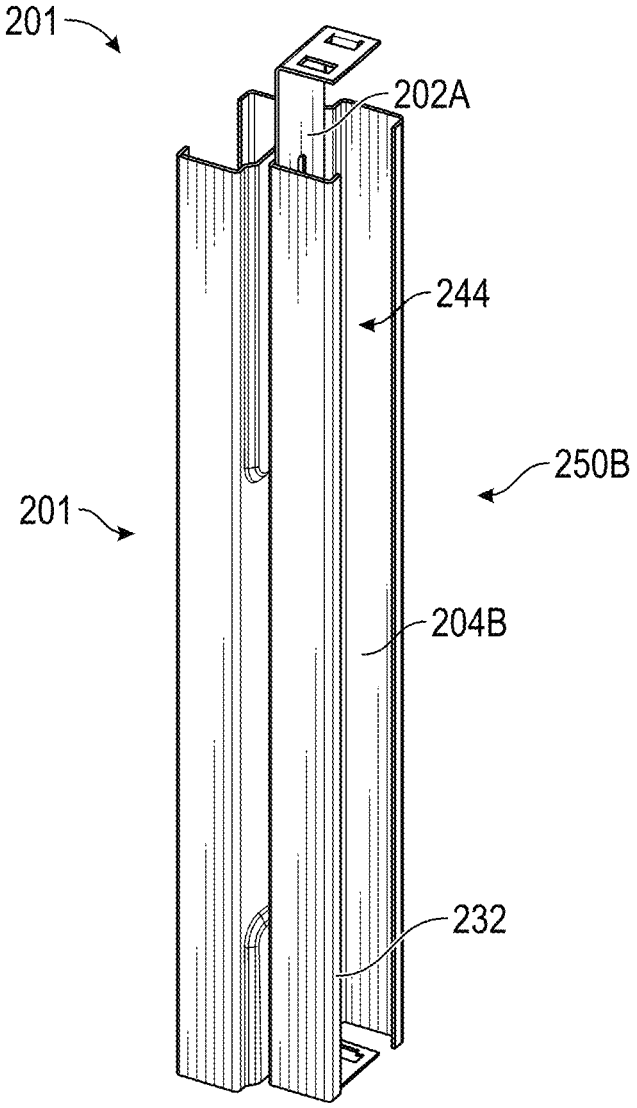
FIG. 8D is an isometric view of the acoustic framing arrangement of FIG. 8A.

FIGS. 5-7 illustrate an example implementation of the connection mechanism 150 for mounting the connectors 102 to respective tracks 106. As indicated, in some examples, the top track 106A includes a connection portion 170. The connection portion 170 may be formed integrally with the top track 106A and disposed along the web 114 of the top track 106A as indicated, or may be mounted to the web 114 as a discrete component. In some examples, the connection portion 170 includes a first connection member 172A defining an end 173A and a second connection member 172B defining an end 173B. In these examples, the base portion 142A of the first connector 102A further defines a guide tab 174A extending below the base portion 142A directly adjacent to an opening 176A; and further defines a guide tab 174B extending below the base portion 142A directly adjacent to an opening 176B. The guide tabs 174 and the openings 176 of the base portion 142A engage with the first connection member 172A and the second connection member 172B of the connection portion 170 of the top track 106A to mount the first connector 102A to the top track 106A. Specifically, as indicated in FIGS. 5-6, the first connection member 172A (which may define a track clamp) passes though the opening 176A and at least a portion of the first connection member 172A temporarily deflects from an original configuration to a deflected configuration as the first connection member 172A passes along the surfaces of the base portion 142A defining the opening 176A (and/or the guide tab 174A). Once the end 173A of the first connection member 172A passes through the opening 176A, the first connection member 172A returns to its original configuration with the end 173A of the first connection member 172A snapping back into place to rest against the bottom surface 177 of the base portion 142A. Similarly, the second connection member 172B (which may define a track clamp) passes though the opening 176B and at least a portion of the second connection member 172B temporarily deflects from an original configuration to a deflected configuration as the second connection member 172B passes along the surfaces of the base portion 142A defining the opening 176B (and/or the guide tab 174B). Once the end 173B of the second connection member 172B passes through the opening 176B, the second connection member 172B returns to its original configuration with the end 173B of the second connection member 172B snapping back into place to rest against the bottom surface 177 of the base portion 142A. Consequently, the top track 106A at least temporarily mechanically connects with the base portion 142A, restricting movement of the base portion 142A from the top track 106A. The guide tabs 174 may be tapered or angled to facilitate the deflection or guidance of the connection members 172 described. In some examples, the guide tabs 174 are optional, and in other examples the guide tabs are removed or absent from the structure shown.

Referring to FIGS. 8A-8D, another example of an acoustic framing arrangement 201 is shown, similar to the acoustic framing arrangement 101. The subject acoustic framing arrangement contemplates a variation where the vertical portion (244) of a connector 202 (similar or identical to connector 102) is disposed within one of the stud channels, and may be fastened to the stud along any portion of the stud. Specifically in the present example, the acoustic framing arrangement 201 includes a pair of studs 204 positioned in a back-to-back configuration, with one or more connectors 202 positioned within channels of the studs 204. For demonstration, the acoustic framing arrangement 201 includes a first connector 202A positioned between a channel of the second stud 204B, as further described herein.

To further illustrate, studs 204 comprise a first stud 204A including a first stud web 222, a pair of first stud flanges 224 in parallel arrangement and extending orthogonally from longitudinal edges of the first stud web 222, a pair of returns 226 defined along the pair of first stud flanges 224, and a stud channel 250A. In addition, the first stud 204A defines a back surface 228 of the web 222, and at least one of an embossment 230 (230A) defined along the back surface 228 of the web 222 as shown. The embossment/s 230 (and the embossment/s 240) generally comprises a protrusion, or structure formed along and/or extending from the back surfaces of the studs 204 as shown. Similarly, the second stud 204B includes a second stud web 232, a pair of second stud flanges 234 in parallel arrangement and extending orthogonally from longitudinal edges of the second stud web 232, a pair of returns 236 defined along the pair of second stud flanges 234, and a stud channel 250B. In addition, the second stud 204B defines a back surface 238 of the web 232 oriented towards the back surface 228 of the first stud 204A, and at least one of an embossment 240A defined along the back surface 238 of the web 232.

Similar to the acoustic framing arrangement 101, the studs 204 of the acoustic framing arrangement 201 are positioned in an offset configuration. The connector 202A of the acoustic framing arrangement 201 includes a base portion 242 and a vertical portion 244 in communication with the base portion 242. As indicated, at least some portion of the vertical portion 244 is positioned within the stud channel 250B along the second stud 204B. In this example, illustrated in FIG. 8C, securing members 248 such as screws, bolts, nails, or other fasteners pass through a slot 246 of the vertical portion 244 and further pass through the embossment 240A to the embossment 230A to interconnect the studs 204. A channel 262 is formed by the acoustic framing arrangement 201 similar to the channel 162 for improved acoustic performance.

Figure 9A:
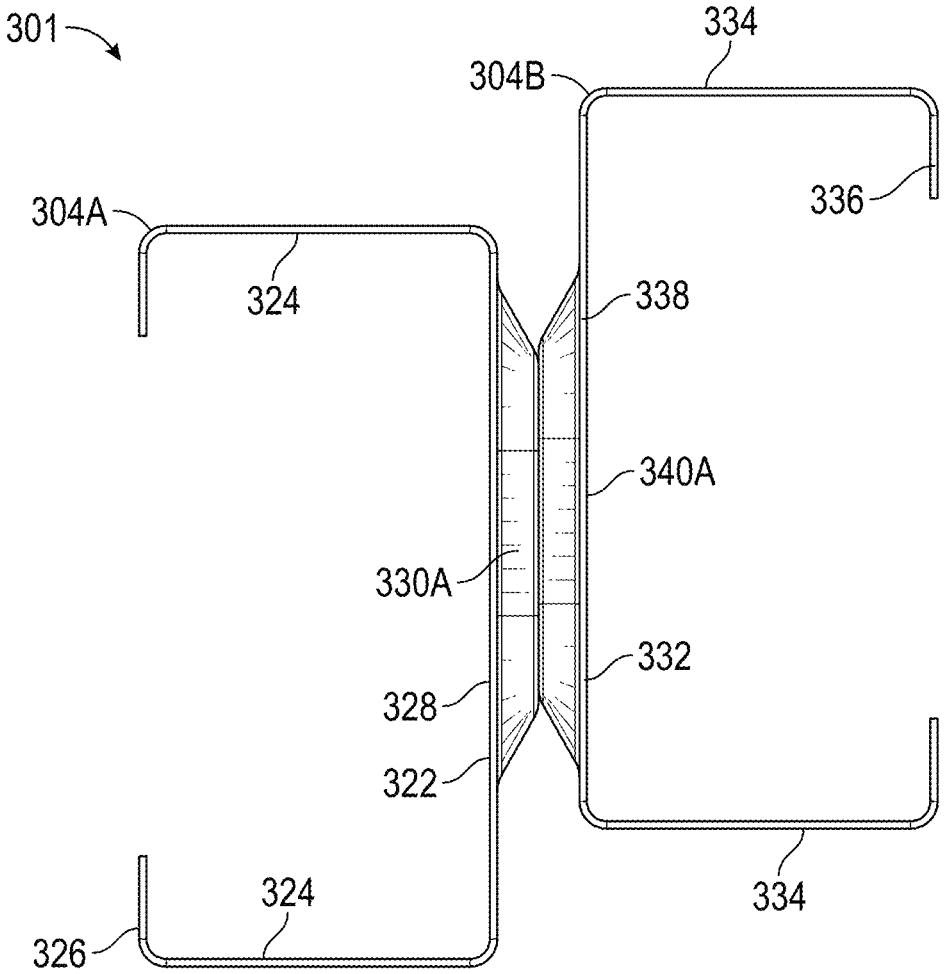
FIG. 9A is a top or plan view of another example of an acoustic framing arrangement devoid of a connector such that two studs are interconnecting along respective embossments.
Figure 9B:
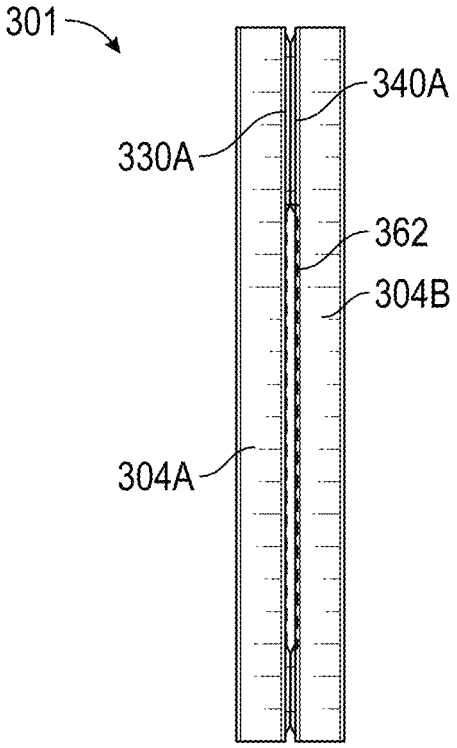
FIG. 9B is a side view of the acoustic framing arrangement of FIG. 9A.
Figure 9C:
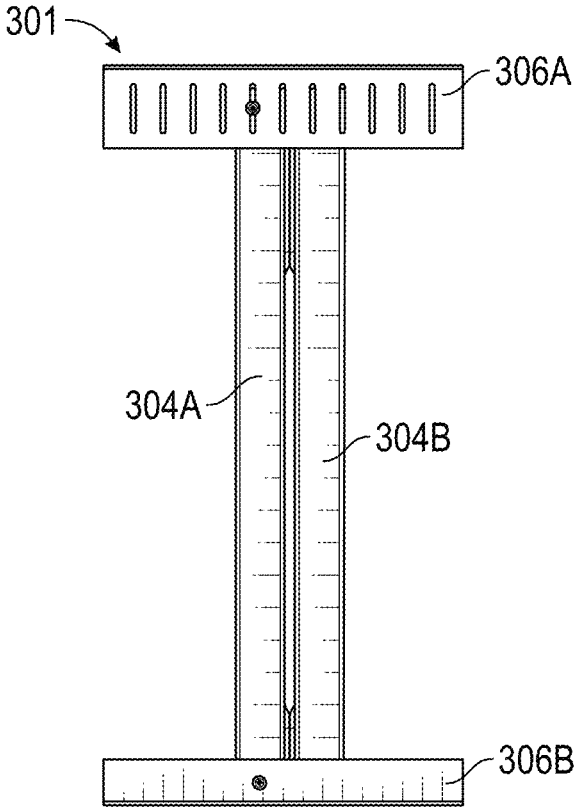
FIG. 9C is another side view of the acoustic framing arrangement of FIG. 9A illustrating connection to one or more tracks.

Referring to FIGS. 9A-9C, another example of an acoustic framing arrangement 301 is shown, similar to the acoustic framing arrangement 101. The subject acoustic framing arrangement 301 contemplates a variation where the studs (304) are fastened (e.g. screwed, welded, riveted) to each other without any connector. Similar to the acoustic framing arrangement 101, the studs 304 of the acoustic framing arrangement 301 are positioned in an offset configuration. Studs 304 comprise a first stud 304A including a first stud web 322, a pair of first stud flanges 324 in parallel arrangement and extending orthogonally from longitudinal edges of the first stud web 322, and a pair of returns 326 defined along the pair of first stud flanges 324. In addition, the first stud 304A defines a back surface 328 of the web 322, and at least one of an embossment 330 (330A) defined along the back surface 328 of the web 322 as shown. The embossment/s 330 (and the embossment/s 340) generally comprises a protrusion, or structure formed along and/or extending from the back surfaces of the studs 304 as shown. Similarly, the second stud 304B includes a second stud web 332, a pair of second stud flanges 334 in parallel arrangement and extending orthogonally from longitudinal edges of the second stud web 332, and a pair of returns 336 defined along the pair of second stud flanges 334. In addition, the second stud 304B defines a back surface 338 of the web 332 oriented towards the back surface 328 of the first stud 304A, and at least one of an embossment 340 (340A) defined along the back surface 338 of the web 332 as shown.

In the present example, the embossment 330A and the embossment 340A are joined together directly using any number of securing members or fasteners, and the acoustic framing arrangement 301 is devoid of a connector. However, the engagement of the first stud 304A with the second stud 304B via the embossments 330 and 340 defines a channel 362 similar to the channel 162 for improved acoustic performance. As shown in FIG. 9C, the acoustic framing arrangement 301 can be fastened to a traditional bottom track (306B) and a traditional slotted top track (306A) using screws.

The framing assembly 100 (including one or more of any combinations of the acoustic framing arrangement 101, the acoustic framing arrangement 201, and/or the acoustic framing arrangement 301) shown may generally define a wall frame or portions thereof, a ceiling frame, or may be leveraged for any framing application requiring a framing structure. The framing assembly 100 is not limited to the general shape configuration depicted, and variations of the framing assembly 100 are contemplated such that the components depicted may be arranged in any predetermined configuration to assemble an overall frame for a building structure or otherwise. Further, while the first connector 102A and the second connector 102B are described herein generally as defining discrete components separate from each other and other components of the framing assembly 100, it is contemplated that in some examples the first connector 102A and/or the second connector 102B may be manufactured integrally with either of the studs 104 or tracks 106 of the framing assembly 100 by way of a robotic assembly process or otherwise.

The components of the framing assembly 100 described herein may be formed using any rigid or semi-rigid material such as a metal, steel, wood, plastic, or the like. Various modifications and variations to the framing assembly 100 are contemplated. For example, it should be appreciated that aspects of the first connector 102A may be swapped with aspects of the second connector 102B, such that features of the connectors 102 may be interchangeable in design. Additional embossments may be formed along the studs 104, and one or more than two of the connectors 102 may be implemented. Further, the connectors 102 may be manufactured integrally with the tracks 106 and/or the studs 104, or each of the aforementioned may be formed independently or discretely and later assembled.

Figure 10:
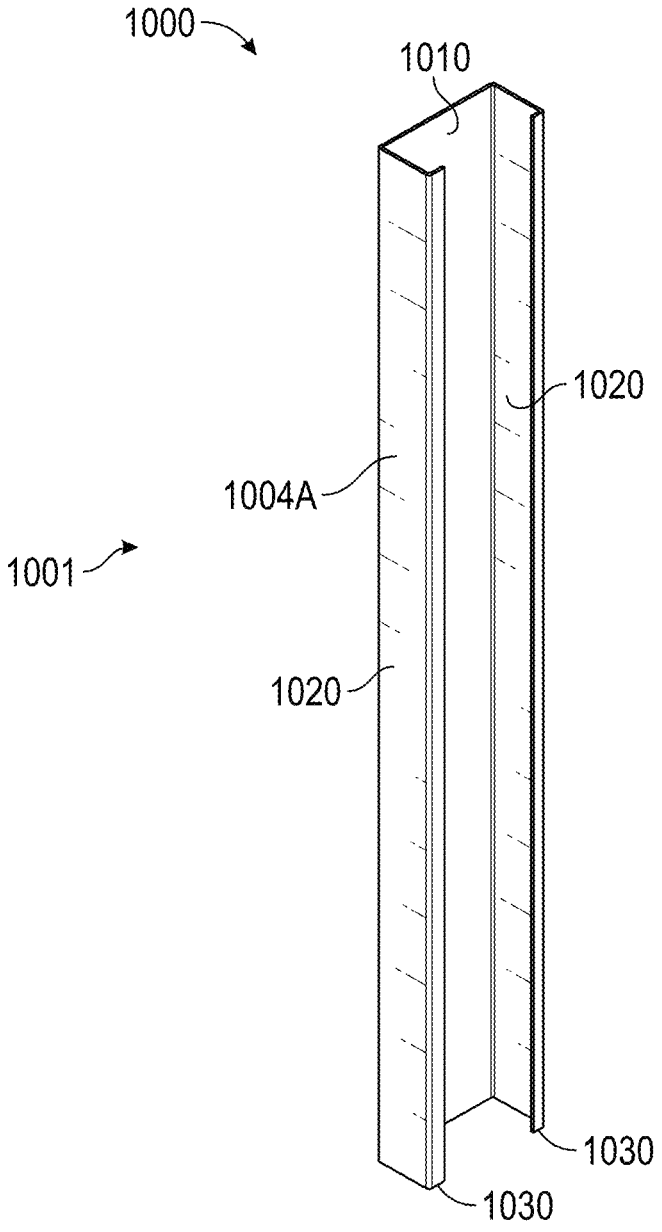
FIG. 10 is an isometric view of a wall stud of another example of the present disclosure.
Figure 11:
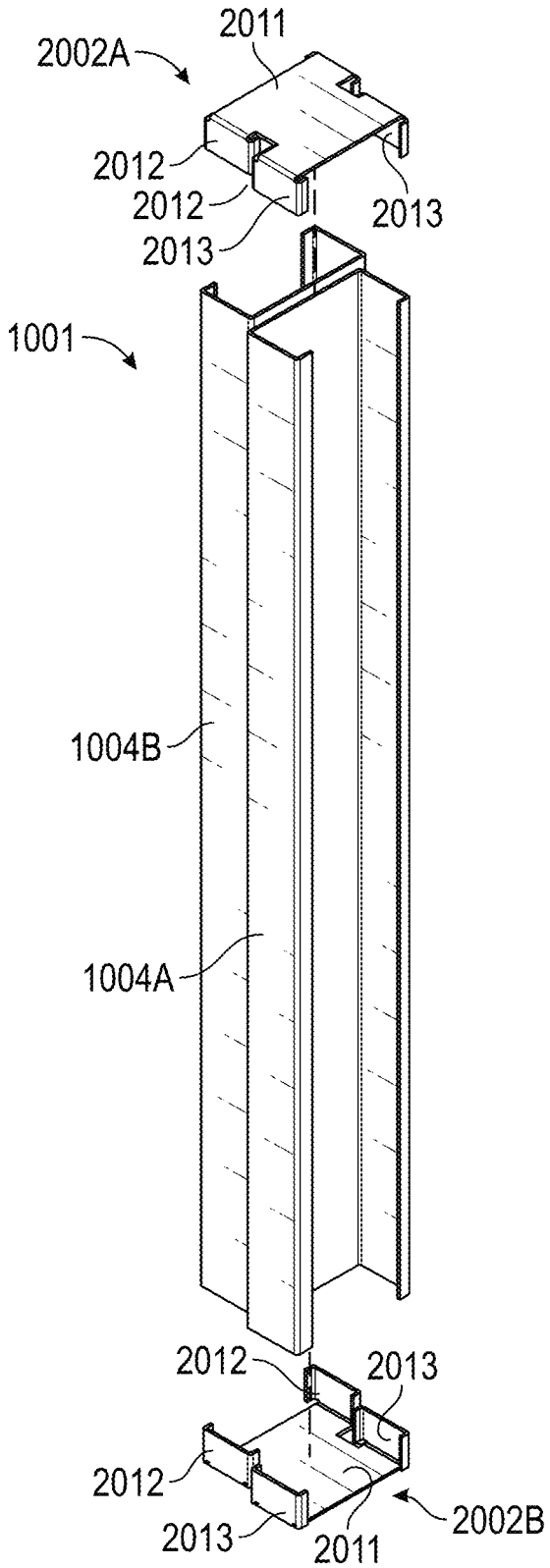
FIG. 11 is an exploded view of another example of an acoustic framing arrangement of the present disclosure that leverages the wall stud example of FIG. 10.

Referring to FIGS. 10-11, another example of a framing assembly designated framing assembly 1000 is shown defining an acoustic framing arrangement 1001. The acoustic framing arrangement 1001 includes a pair studs 1004, including a first stud shown and designated 1004A indicated in FIG. 10. The wall stud 1004A includes a C-shaped cross section defined by a web 1010, a pair of first flanges 1020 extending orthogonally from the longitudinal edges of web 1010, and a pair of second flanges 1030 extending inward from the first flanges 1020. FIG. 11 shows an exploded isometric view of the acoustic wall stud assembly 1001. The acoustic wall stud assembly 1001 consists of two of the wall studs 1004 that are coupled at the top and bottom by connectors 2002 to form an offset configuration. Each connector 2002 includes a base portion 2011, a first pair of flanges 2012, and a second pair of flanges 2013. The first pair of flanges 2012 extends into the wall stud 1004B, and the second pair of flanges 2013 extends into the wall stud 1004A. The wall studs 1004 can be secured to the connectors 2002 using screws, rivets, welds, and the like. The acoustic framing arrangement 1001 may be factory-manufactured and delivered to construction sites in bundles for use in framing partition walls.

Figure 12:
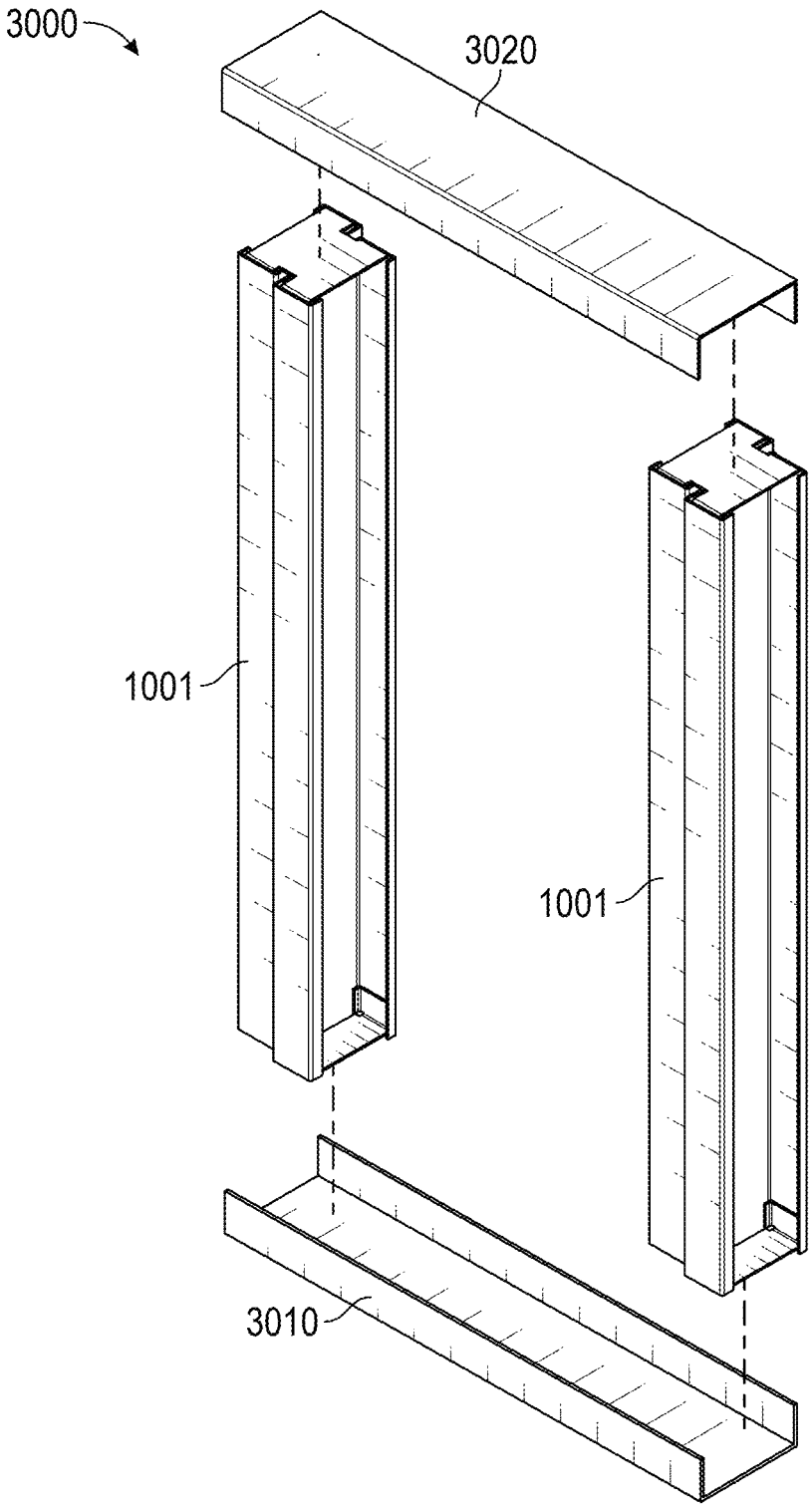
FIG. 12 is an exploded system view illustrating implementation of the acoustic framing arrangement of FIG. 11.

FIG. 12 shows an exploded isometric view of a partition wall frame 3000, which includes of two of the acoustic framing arrangements 1001, a bottom track 3010, and a top track 3020. Although partition wall frame 3000 contains only two acoustic framing arrangements 1001, it should be appreciated that additional acoustic framing arrangements 1001 can be added to create a longer partition wall. In the construction of the partition wall frame 3000, the installer inserts the bottom portion of each acoustic framing arrangement 1001 into the channel of bottom track 3010 and the top portion of each acoustic framing arrangement 1001 into the channel of top track 3020. The acoustic framing arrangements 1001 can be secured into bottom track 3010 and top track 3020 using screws, rivets, and the like. The assembled configuration of the partition wall frame 3000 is similar to a traditional chase wall. However, since each acoustic framing arrangement 1001 combines two wall studs 1004 into a single installable unit, the construction of partition wall frame 3000 can be up to twice as labor efficient as a traditional chase wall.

Figure 13:
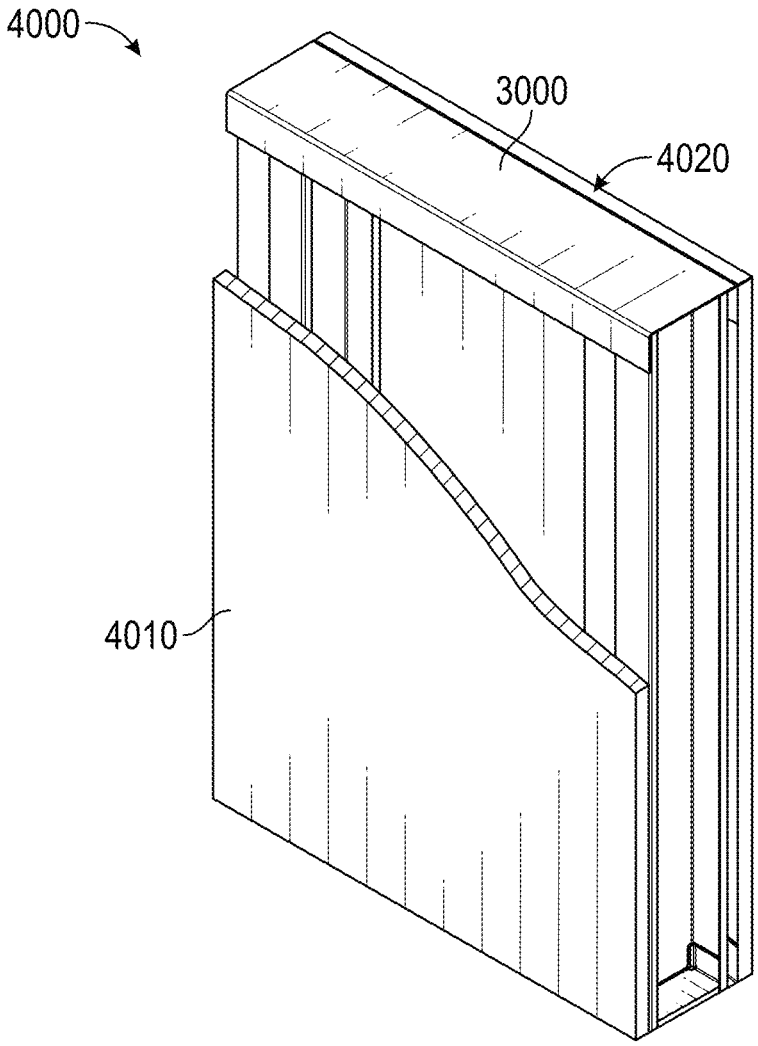
FIG. 13 is an isometric view of a system example leveraging the acoustic framing arrangement of FIG. 11 with wall coverings showing a cut-away portion as further described herein.

FIG. 13 shows an assembled isometric view of a finished partition wall 4000, in which partition wall frame 3000 is sheathed on the proximal side by a first wall covering 4010 and on the distal side by a second wall covering 4020. The first wall covering 4010 and the second wall covering 4020 can be of gypsum wall board or any other suitable material.

Figure 14:
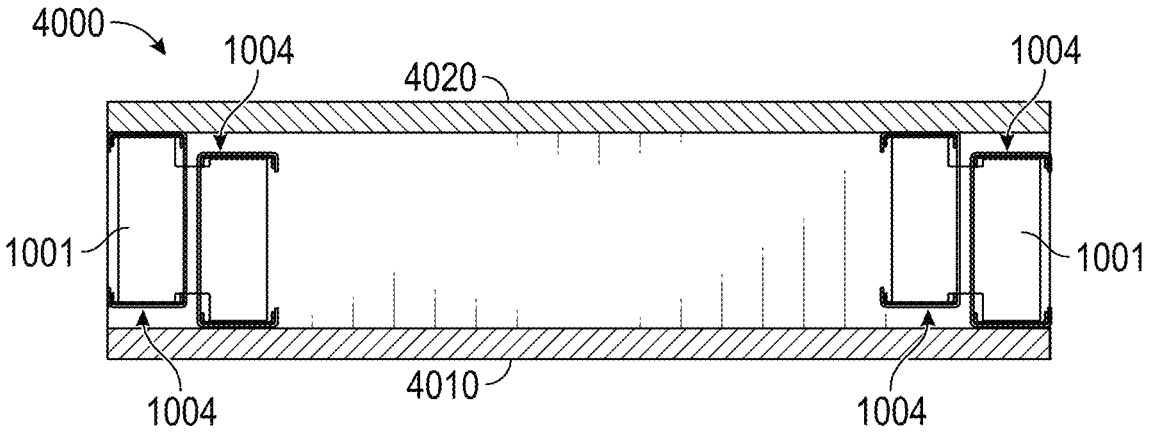
FIG. 14 is a plan or top view of the acoustic framing arrangement of FIG. 11 implemented by the example of FIG. 13.

FIG. 14 shows a top cross section view of the finished partition wall 4000. Aside from the very top and bottom of the finished partition wall 4000, where the acoustic framing arrangements 1001 are coupled by connectors 2002, bottom track 3010, and/or top track 3020, it is evident that the first wall covering 4010 is mechanically isolated from the second wall covering 4020. The wall studs 1004 which carry the first wall covering 4010 do not contact the second wall covering 4020. Likewise, the wall studs 1004 which carry the second wall covering 4020 do not contact the first wall covering 4010. In this configuration, when the first wall covering 4010 experiences mechanical vibration from incident airborne pressure waves, there is no bridge of solid material that would carry mechanical vibrations to the second wall covering 4020, other than at the very top and bottom of the finished partition wall 4000. In this manner, the finished partition wall 4000 has acoustic properties that are similar to a traditional chase wall.

Figure 15:
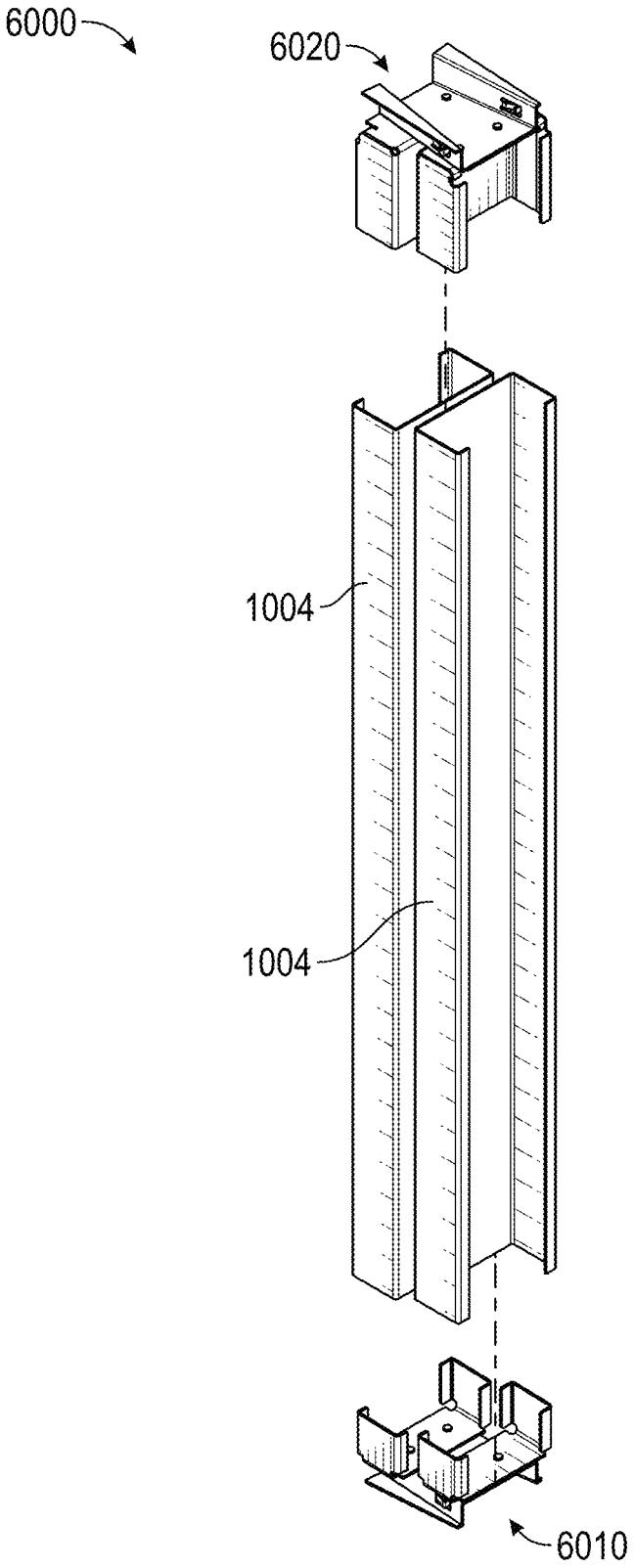
FIG. 15 is an isometric exploded view of another example of an acoustic framing arrangement.
Figure 16:
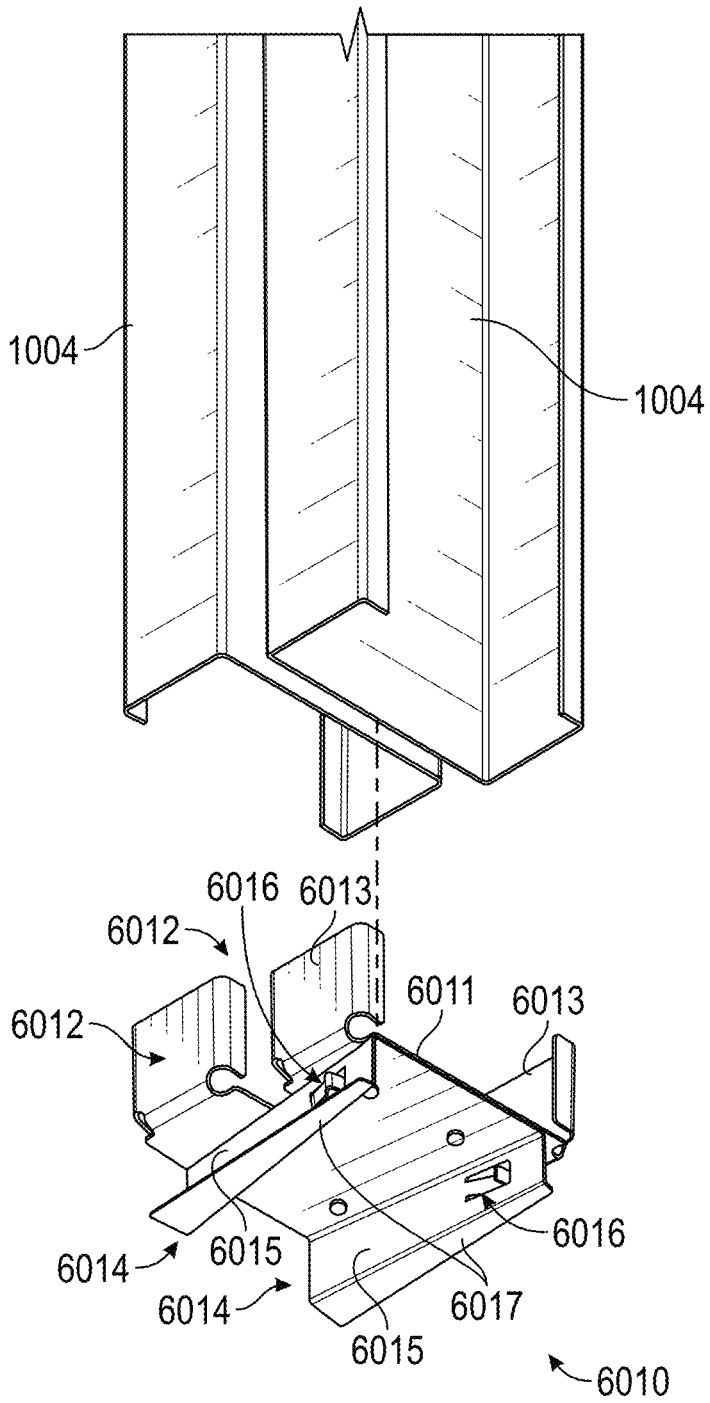
FIG. 16 is a detailed view illustrating a bottom connection between a connector of the acoustic framing arrangement example of FIG. 15 and a pair of wall studs.
Figure 17:
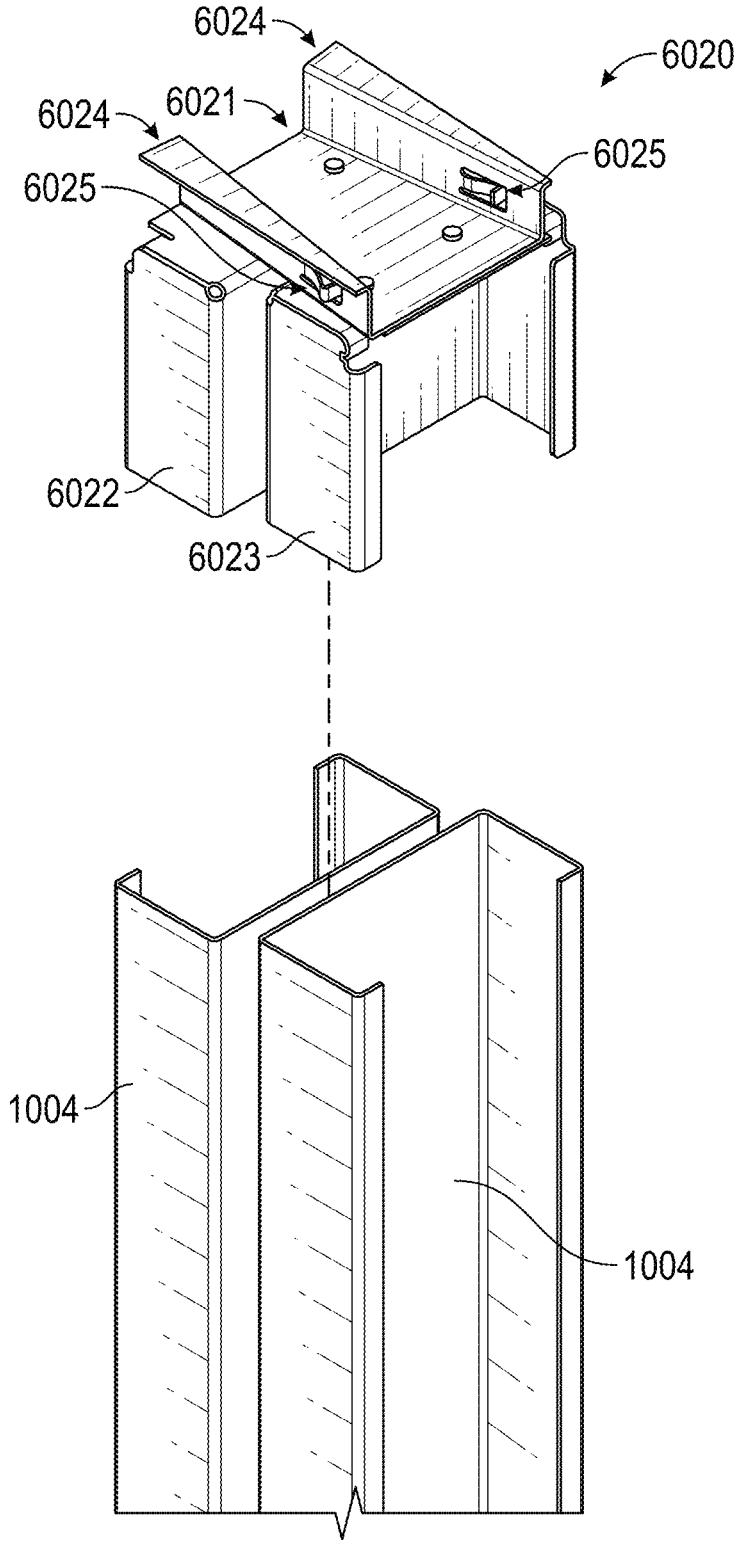
FIG. 17 is a detailed view illustrating a top connection between a connector of the acoustic framing arrangement example of FIG. 15 and a pair of wall studs.

FIG. 15 shows an exploded assembly view of an alternative example—acoustic wall stud assembly 6000—where two wall studs 1004 are coupled by a bottom end connector 6010 and a top end connector 6020. FIG. 16 shows an exploded isometric view of the bottom of the acoustic wall stud assembly 6000. The bottom end connector 6010 includes a base portion 6011, a first pair of vertical flanges 6012, a second pair of vertical flanges 6013, and a pair of ears 6014 extending downward from the base portion 6011. The first pair of vertical flanges 6012 extends into the first wall stud 1004, and the second pair of vertical flanges 6013 extends into the second wall stud 1004. Each ear 6014 contains a vertical portion 6015, a spring tab 6016 extending outward from the vertical portion 6015, and a horizontal portion 6017. The wall studs 1004 can be secured to the bottom end connector 6010 using screws, rivets, welds, and the like in order to form a fixed connection. FIG. 17 shows an exploded isometric view of the top of the acoustic wall stud assembly 6000. The top end connector 6020 includes a base portion 6021, a first vertical C-channel 6022, a second vertical C-channel 6023, and a pair of ears 6024 extending upward from the base portion 6021. Each ear 6024 contains a spring tab 6025 extending outward from the body of the ear 6024. The first vertical C-channel 6022 extends into the first wall stud 1004, and the second vertical C-channel 6023 extends into the second wall stud 1004, such that the top end connector 6020 can slide telescopically with respect to the wall studs 1004. The telescoping action of the top end connector 6020 with respect to the wall studs 1004 accommodates vertical head of wall deflection in the event of normal building movement or seismic activity.

Figure 18:
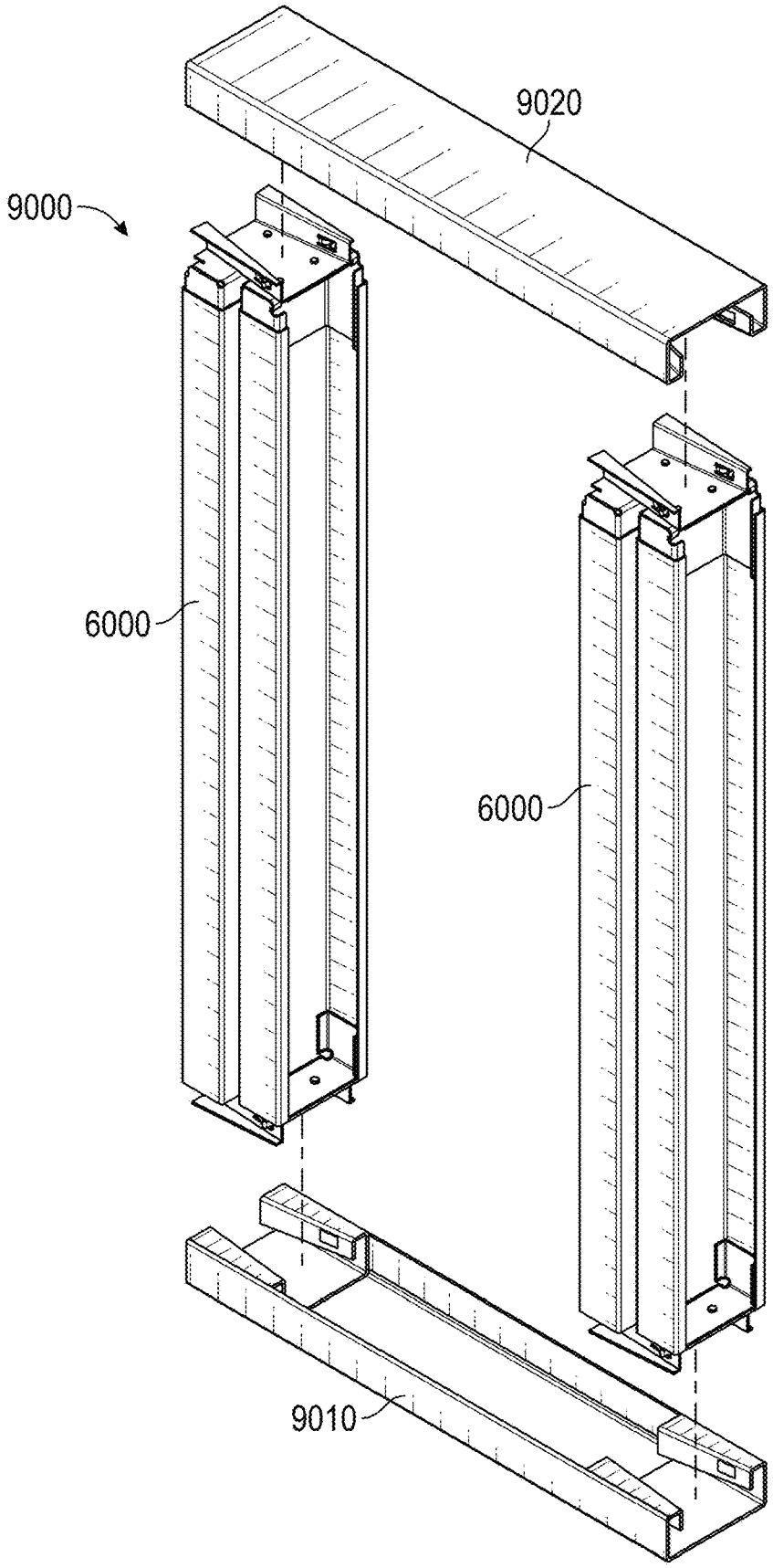
FIG. 18 is an exploded view of a system leveraging the acoustic framing example of FIG. 15 to form a wall.

FIG. 18 shows an exploded isometric view of a partition wall frame 9000, which consists of two acoustic wall stud assemblies 6000, a bottom track 9010, and a top track 9020. Although the partition wall frame 9000 contains only two acoustic wall stud assemblies 6000, it is appreciated that additional acoustic wall stud assemblies 6000 can be added to create a longer partition wall. The partition wall frame 9000 is similar to the partition wall frame 3000, except that the bottom track 9010 and the top track 9020 contain features to form snap-locking connections with the acoustic wall stud assemblies 6000.

Figure 19A:
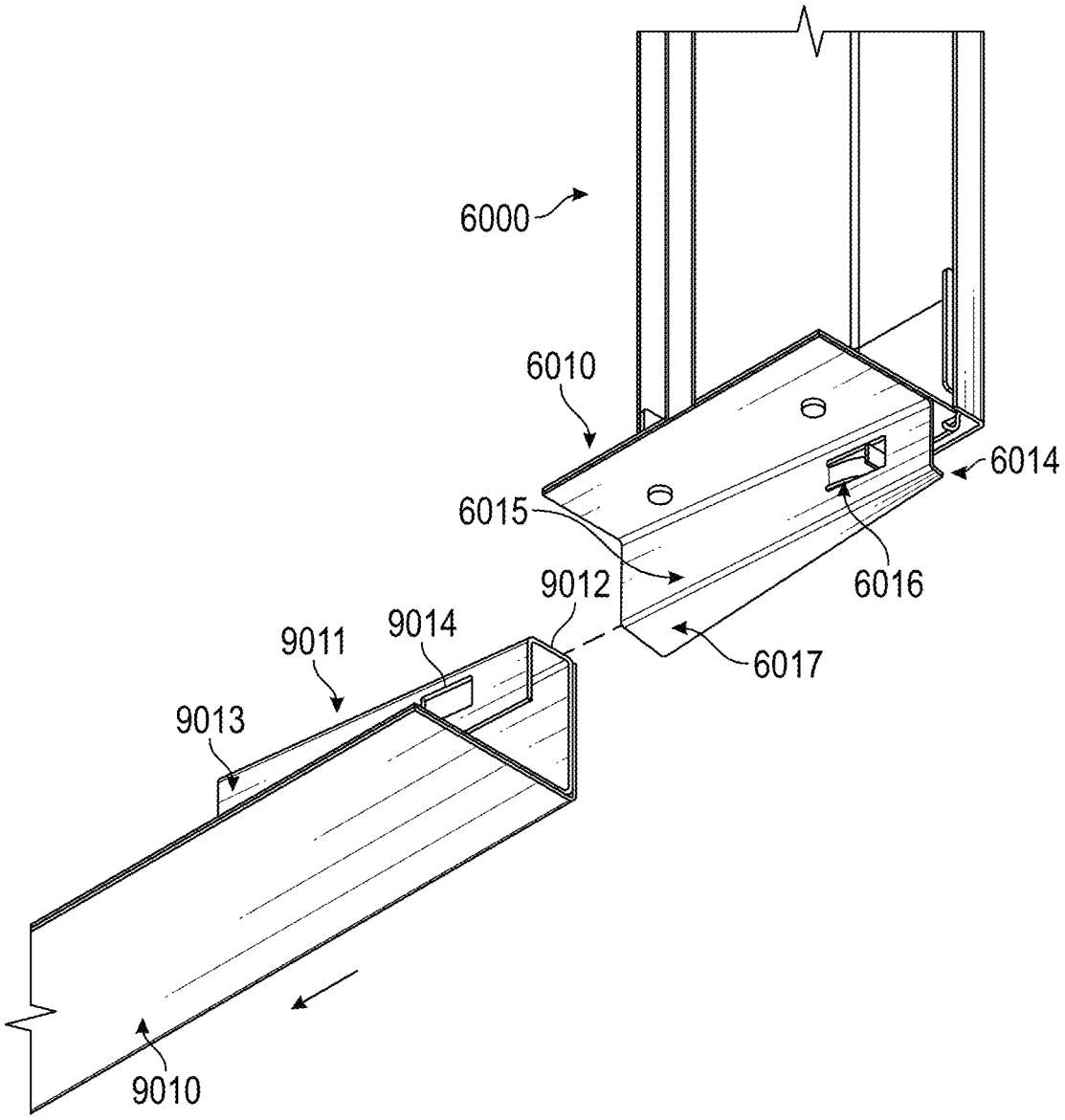
FIG. 19A is a detailed view illustrating a first phase of an example connection mechanism defined by the connector of FIGS. 16-18.

FIG. 19A shows a cutaway isometric view of the bottom of an acoustic wall stud assembly 6000 and its corresponding connection point on the bottom track 9010—before the installer begins to make the connection. The view is cut away halfway through the thickness of the partition wall frame 9000, such that the portion of the bottom track 9010 not shown is symmetrical about the cutaway plane to the portion pictured. Likewise, the portion of the bottom end connector 6010 not shown includes an ear 6014 and a spring tab 6016 that are symmetrical about the cutaway plane to the portion pictured.

In this view, it is evident that the vertical portion 6015 of the ear 6014 tapers linearly inward toward the cutaway plane. Likewise, the horizontal portion 6017 of the ear 6014 tapers downward. The bottom track 9010 contains a track ear 9011 that is designed to mate with the bottom end connector 6010. The track ear 9011 comprises a horizontal portion 9012 extending inward toward the cutaway plane and a vertical portion 9013 extending downward. The vertical portion 9013 tapers inward toward the cutaway plane, at an angle that matches the taper of the vertical portion 6015. The bottom edge of the vertical portion 9013 tapers downward at an angle that matches the taper of the horizontal portion 6017. The vertical portion 9013 further contains a hole 9014. To make the connection, the installer urges the acoustic wall stud assembly 6000 towards the track ear 9011 along the axis defined by the arrow shown.

Figure 19B:
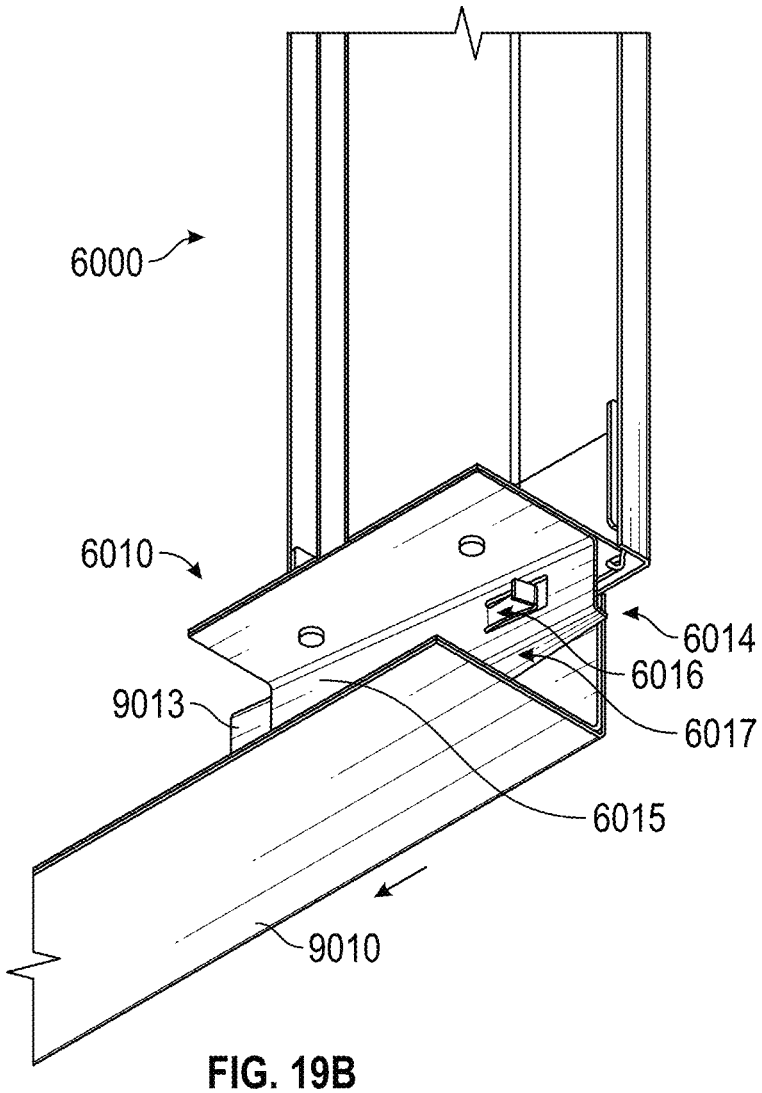
FIG. 19B is a detailed view illustrating a second phase of an example connection mechanism defined by the connector of FIGS. 16-18.

FIG. 19B shows a cutaway isometric view of the bottom of the acoustic wall stud assembly 6000 midway through the process of making a snap connection with the bottom track 9010. As the spring tab 6016 slides against the vertical portion 9013, it temporarily bends inward toward the cutaway plane and rubs along the vertical portion 9013.

Figure 19C:
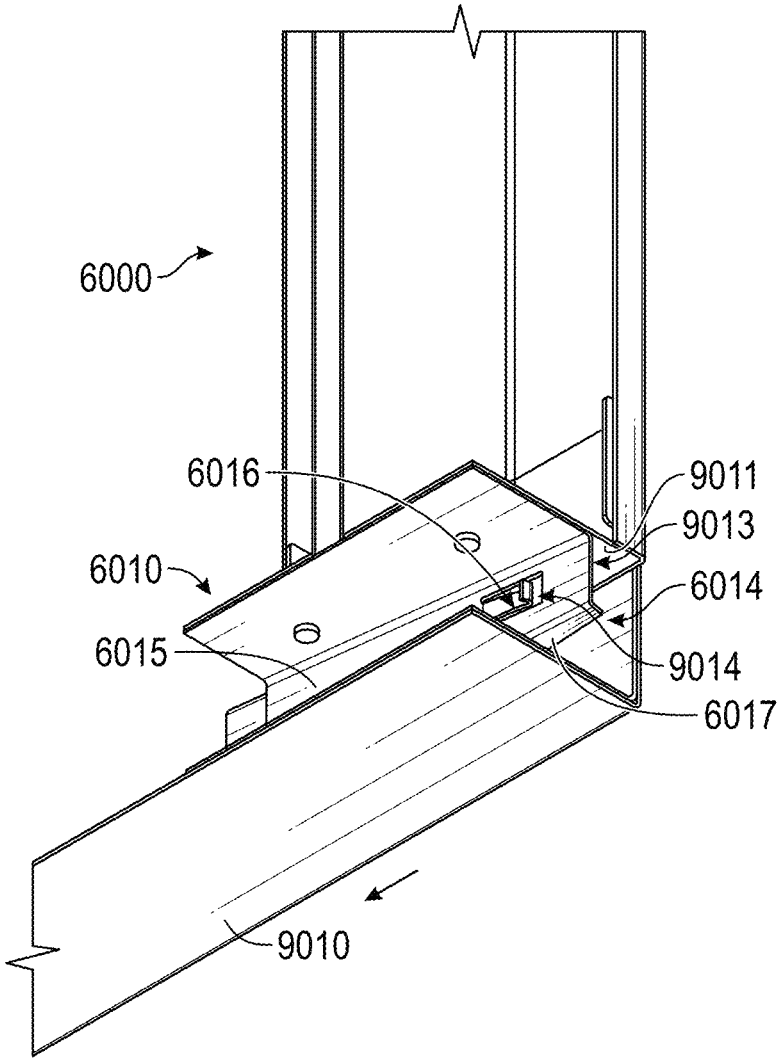
FIG. 19C is a detailed view illustrating a third phase of an example connection mechanism defined by the connector of FIGS. 16-18.

FIG. 19C shows a cutaway isometric view of the bottom of the acoustic wall stud assembly 6000 after it is completely connected to the bottom track 9010. In this view, the vertical portion 6015 of the ear 6014 is in full contact with the vertical portion 9013 of the track ear 9011, preventing any further motion of the acoustic wall stud assembly 6000 with respect to the bottom track 9010 in the direction of the arrow shown. Furthermore, the hole 9014 has provided clearance for the spring tab 6016 to return to its original position, which now extends through the hole 9014. The contact between the spring tab 6016 and the proximal vertical edge of the hole 9014 retains the connection in the locked configuration. Finally, the manner in which the bottom end connector 6010 wraps around the track ear 9011 prevents the acoustic wall stud assembly 6000 from moving vertically with respect to the bottom track 9010.

It is appreciated that the retention features cited above may be swapped to achieve equivalent functionality, such that the spring tab 6016 is located on the bottom track 9010 and the hole 9014 is located on the bottom end connector 6010. Generally, the acoustic wall stud assembly 6000 and the bottom track 9010 can have other mating geometries while maintaining the utility of a snap-locking connection. The snap-locking connection illustrated by FIGS. 19A-19C is repeated in the upside-down orientation for the connection between the top end connector 6020 and the top track 9020. Snap-locking connections enable labor-efficient installation of the acoustic wall stud assembly 6000 to the bottom track 9010 and the top track 9020 because neither hand tools nor separate mechanical fasteners are necessary to form the connection.

Figure 20:
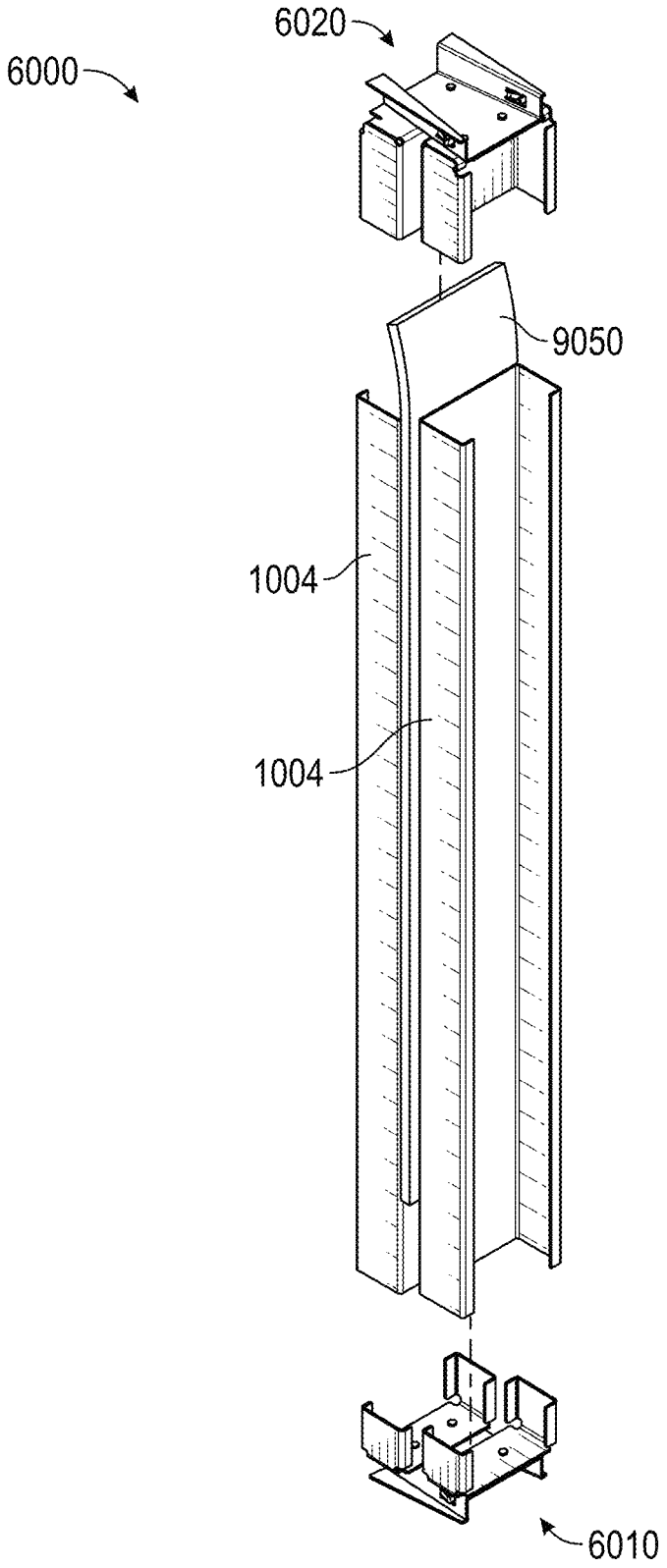
FIG. 20 is an isometric exploded view of another example of an acoustic framing arrangement.

FIG. 20 shows an alternative example of the acoustic wall stud assembly 6000, in an exploded isometric assembly view, where a layer of sound attenuating insulation 9050 (e.g. mineral wool) is sandwiched between the wall studs 1004. The sound attenuating insulation 9050 would absorb airborne sound that is generated inside the wall cavity between the wall studs 1004. It is anticipated that the sound attenuating insulation 9050 would be factory-applied, as it would be tedious and difficult to apply in field conditions. The sound attenuating insulation 9050 can be applied with a friction fit between the wall studs 1004 or with adhesive to one of the wall studs 1004.

Figure 21:
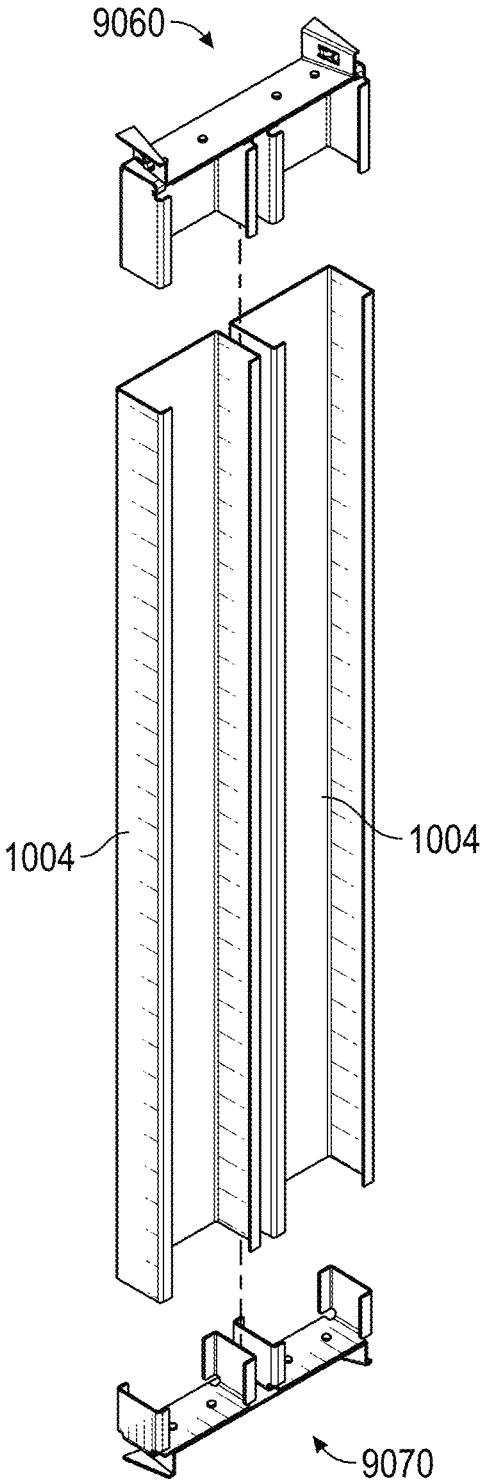
FIG. 21 is an isometric exploded view of another example of an acoustic framing arrangement.

FIG. 21 shows an alternative example of the invention, in an exploded isometric view, where two wall studs 1004 are coupled by a bottom end connector 9070 and a top end connector 9060 to form a linear (side-by-side) configuration. The wall studs 1004 can be secured to the bottom end connector 9070 and the top end connector 9060 using screws, rivets, welds, and the like. This configuration is suitable for double thickness walls where it is desirable to achieve a two-fold labor savings by installing a pair of wall studs 1004 as a single unit. This disclosure should not be taken to limit the position of the first wall stud 1004 with respect to the second wall stud 1004 when they are coupled by end connectors.

It is believed that the present disclosure and many of its attendant advantages should be understood by the foregoing description, and it should be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various examples, it should be understood that these examples are illustrative and that the scope of the disclosure is not limited to such examples. Many variations, modifications, additions, and improvements are possible. More generally, examples in accordance with the present disclosure have been described in the context of particular implementations. Functionality may be separated or combined in blocks differently in various examples of the disclosure or described with different terminology. These and other variations, modifications, additions, and improvements may fall within the scope of the disclosure as defined in the claims that follow.

What is claimed is:

1. A framing assembly, comprising:

an acoustic framing arrangement configured for connection to a first track, including:

a first stud including a first stud web, a pair of first stud flanges in parallel arrangement and extending orthogonally from longitudinal edges of the first stud web, and a first embossment defined along a rear surface of the first stud web, the first stud defining a first stud end oriented towards the first track, a second stud including a second stud web, a pair of second stud flanges in parallel arrangement and extending orthogonally from longitudinal edges of the second stud web, and a second embossment defined along a rear surface of the second stud web, the second stud defining a second stud end oriented towards the first track, and a first connector including a vertical portion and a base portion configured for engagement to the first track, the vertical portion disposed between the first stud and the second stud that connects with the first embossment and the second embossment, wherein the acoustic framing arrangement defines a channel between the first stud and the second stud to mechanically isolate the first stud from the second stud, and the first connector is engaged to the first stud and the second stud such that the first stud end is offset relative to the second stud end.

2. The framing assembly of claim 1, further comprising:

a slot defined along the vertical portion of the first connector such that the vertical portion of the first connector is slidable a predetermined distance along the first embossment and the second embossment by nature of the slot to accommodate head-of-wall deflection with respect to the first track.

3. The framing assembly of claim 1, further comprising:

wherein the first track includes a first track web, a first flange extending along a first side of the first track web, and a second flange extending along a second side of the first track web opposite the first side, the first track defining a first track channel between the first flange and the second flange of the first track, and wherein the acoustic framing arrangement engages with the first track such that the second stud abuts the second flange of the first track and a gap is defined between the first stud and the second flange of the first track.

4. The framing assembly of claim 3, further comprising:

a first wall covering disposed over the first flange of the first track; and a second wall covering disposed over the second flange of the first track, wherein a gap is defined between a first flange of the pair of first stud flanges of the first stud and the second wall covering.

5. The framing assembly of claim 1, wherein by assumption of the acoustic framing arrangement the rear surface of the first stud is separated from the rear surface of the second stud.

6. The framing assembly of claim 3, wherein in the acoustic framing arrangement the first stud end and the second stud end are offset from one another relative to the first flange and the first track channel of the first track.

7. The framing assembly of claim 1, wherein in the acoustic framing arrangement, the first stud and the second stud are in at least a partial back-to-back configuration such that the pair of first stud flanges is oriented away from the pair of second stud flanges.

8. The framing assembly of claim 1, further comprising:

a second track vertically aligned over the first track, the second track including a second track web, and a pair of second track flanges in parallel arrangement and extending orthogonally from longitudinal edges of the second track web, the second track defining a second track channel between the pair of second track flanges, the acoustic framing arrangement interconnecting the first track with the second track and disposed between the first track and the second track.

9. The framing assembly of claim 1, wherein the acoustic framing arrangement further includes:

a third embossment defined along the rear surface of the first stud a predetermined distance from the first embossment, a fourth embossment defined along the rear surface of the second stud and positioned the predetermined distance from the second embossment, the fourth embossment oriented towards the third embossment, and a second connector including a vertical portion and a base portion in communication with the vertical portion, the vertical portion of the second connector disposed between and engaged to the third embossment and the fourth embossment.

10. The framing assembly of claim 1, wherein the first stud, the second stud, and the first connector are formed integrally during manufacturing and configured as a single installable unit for installation to the first track.

11. The framing assembly of claim 1, further comprising:

a snap-fit mechanism that mechanically engages the first connector of the acoustic framing arrangement to the first track, including:

an opening formed adjacent the opening along the base portion of the first connector, and a track clamp defined along a web of the first track that passes through the opening and locks about the base portion of the first connector such that an end of the track clamp rests against a bottom surface of the base portion restricting movement of the first connector away from the first track.

12. The framing assembly of claim 1, wherein the channel extends from the first embossment and the second embossment to a predetermined position along the first stud and the second stud, the channel creating separation and reducing sound transmission through the first stud and the second stud.

13. The framing assembly of claim 12, wherein the channel is air-filled.

14. The framing assembly of claim 12, further comprising:

an acoustic insulation layer disposed within the channel.

15. A framing assembly, comprising:

an acoustic framing arrangement configured for connection to a track, including:

a first stud including a first stud web and a pair of first stud flanges in parallel arrangement and extending orthogonally from longitudinal edges of the first stud web, a second stud including a second stud web and a pair of second stud flanges in parallel arrangement and extending orthogonally from longitudinal edges of the second stud web, the first stud and the second stud aligned in a parallel configuration, a first connector including a vertical portion and a base portion, the vertical portion disposed between and interconnecting the first stud with the second stud, the first connector separating the first stud from the second stud and interconnecting the first stud in an offset position relative to the second stud, a first embossment formed along a rear surface of the first stud, and a second embossment formed along a rear surface of the second stud, the first connector engaged to the first embossment and the second embossment.

16. The framing assembly of claim 15, further comprising:

a snap-fit connection mechanism defined along the base portion of the first connector configured for connection to a track.

17. A method of making a framing assembly, comprising:

forming an acoustic framing arrangement configured for connection to a track, including:

providing a first stud including a first stud web, a pair of first stud flanges in parallel arrangement and extending orthogonally from longitudinal edges of the first stud web;

providing a second stud including a second stud web, a pair of second stud flanges in parallel arrangement and extending orthogonally from longitudinal edges of the second stud web, the first stud and the second stud aligned in a parallel configuration such that a rear surface of the first stud is oriented towards a rear surface of the second stud; and interconnecting the first stud with the second stud using a first connector defining a base portion and a vertical portion, the first connector separating the rear surface of the first stud from the rear surface of the second stud and interconnecting the first stud in an offset position relative to the second stud, wherein the first stud includes a first embossment formed along the rear surface of the first stud, and the second stud includes a second embossment formed along the rear surface of the second stud, the first connector engaged to the first embossment and the second embossment.

18. The method of claim 17, further comprising:

providing a first track including a first track web, a first flange extending along a first side of the first track web, and a second flange extending along a second side of the first track web opposite the first side, the first track defining a first track channel between the first flange and the second flange of the first track; and connecting the base portion of the first connector to a connection portion of the first track.

* * * * *